US005406884A

United States Patent [19]

Okuda et al.

[11] Patent Number: 5,406,884

[45] Date of Patent: Apr. 18, 1995

[54] SHEET TRANSFERRING APPARATUS FOR PRINTING MACHINE

[75] Inventors: Masaharu Okuda, Seki; Haruki Umemura, Mino, both of Japan

[73] Assignee: Sakurai Graphic Systems Corporation, Japan

[21] Appl. No.: 237,684

[22] Filed: May 4, 1994

[30] Foreign Application Priority Data

May 13, 1993 [JP] Japan ..... 5-111914
Dec. 7, 1993 [JP] Japan ..... 5-306828

[51] Int. Cl.[6] ..... B41F 9/00

[52] U.S. Cl. ..... 101/137; 101/183; 101/230

[58] Field of Search ..... 101/136, 137, 140, 142, 101/145, 177, 183, 184, 185, 217, 218, 229, 230, 246, 247

[56] References Cited

U.S. PATENT DOCUMENTS

| | | | |
|---|---|---|---|
| 4;014,261 | 3/1977 | Becker | 101/183 |
| 4,457,231 | 7/1984 | Kawaguchi | 101/230 |
| 4,669,050 | 5/1987 | Buschmann et al. | 101/184 |
| 4,930,414 | 6/1990 | Wirz | 101/183 |
| 4,960,049 | 10/1990 | Mimura et al. | 101/217 |
| 4,976,197 | 12/1990 | Yamanari et al. | 101/137 |
| 5,063,843 | 11/1991 | Becker | 101/83 |
| 5,076,164 | 12/1991 | Becker | 101/183 |
| 5,105,737 | 4/1992 | Becker | 101/230 |
| 5,327,829 | 7/1994 | Miyoshi et al. | 101/177 |
| 5,335,597 | 8/1994 | Helmstädter | 101/142 |

FOREIGN PATENT DOCUMENTS

| | | |
|---|---|---|
| 4322477A1 | 7/1993 | Germany . |
| 4152139 | 5/1992 | Japan . |
| 2269370A | 2/1994 | United Kingdom . |

*Primary Examiner*—Eugene H. Eickholt
*Attorney, Agent, or Firm*—Nawrocki, Rooney & Sivertson

[57] ABSTRACT

A sheet transferring apparatus transfers a sheet between a plurality of printing units. Multiple color press on a single surface of the sheet and a single color press on both surfaces of the sheet are selectively performed. A feed cylinder is rotatably provided between the adjacent units. A power source actuates the feed cylinder. A first rotating member is mechanically connected to the power source. A second rotating member is mechanically connected to the feed cylinder. The second member is arranged to be driven by said first member. A phase adjusting mechanism automatically adjusts a phase between the first and second members in accordance with the multiple color press and the single color press.

17 Claims, 25 Drawing Sheets

Fig.12

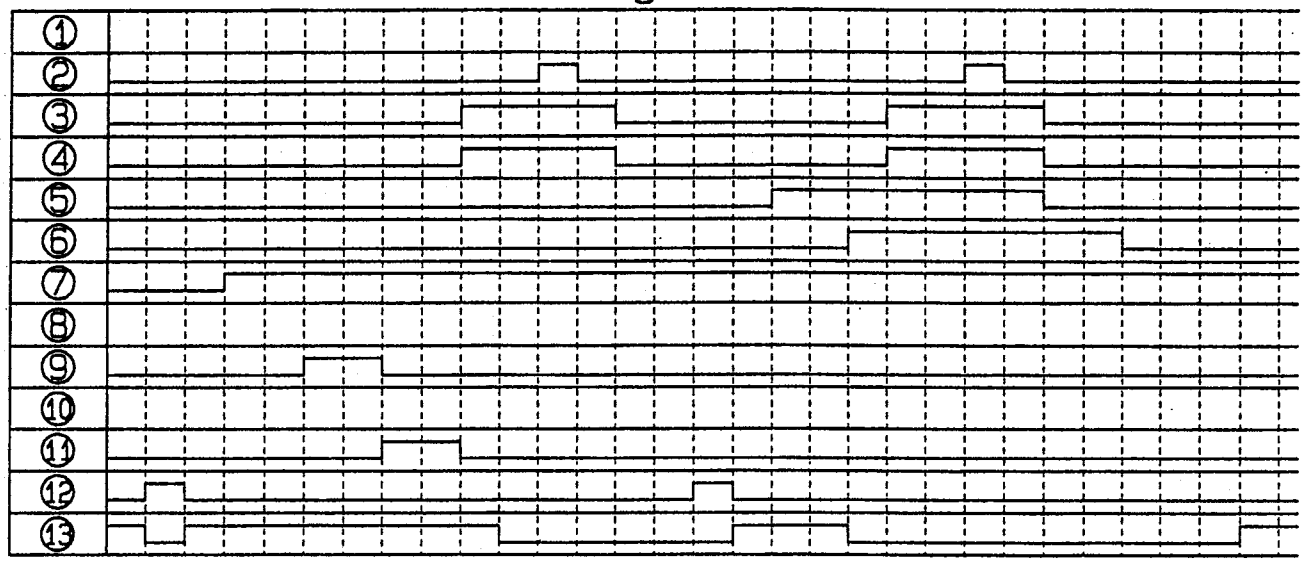

① Normal revolution of phase control motor (min.direction)
② Reverce revolution of phase control motor (max.direction)
③ Phase controlling electromagnetic cluch
④ Phase controlling electromagnetic brake
⑤ Transfer cylinder segment lock electromagnetic valve (ON: release)
⑥ Transfer cylinder lock pin electromagnetic valve (ON: immobilize)
⑦ Sheet guide electromagnetic valve (ON: doble side)
⑧ Holder open/close cam electromagnetic valve (single side)
⑨ Holder open/close cam electromagnetic valve (double side)
⑩ Holder reversing cam electromagnetic valve (single side)
⑪ Holder reversing cam electromagnetic valve (double side)
⑫ Main motor normal revolution
⑬ Main motor brake

Fig. 14

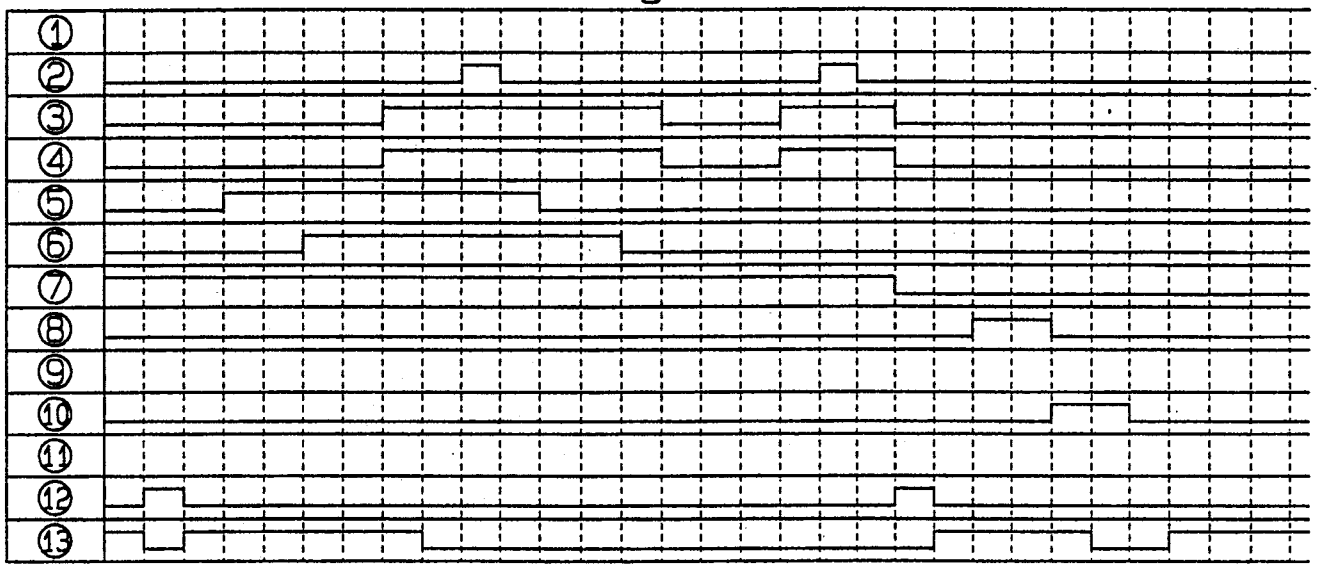

① Normal revolution of phase control motor (min.direction)
② Reverce revolution of phase control motor (max.direction)
③ Phase controlling electromagnetic cluch
④ Phase controlling electromagnetic brake
⑤ Transfer cylinder segment lock electromagnetic valve (ON: release)
⑥ Transfer cylinder lock pin electromagnetic valve (ON: immobilize)
⑦ Sheet guide electromagnetic valve (ON: doble side)
⑧ Holder open/close cam electromagnetic valve (single side)
⑨ Holder open/close cam electromagnetic valve (double side)
⑩ Holder reversing cam electromagnetic valve (single side)
⑪ Holder reversing cam electromagnetic valve (double side)
⑫ Main motor normal revolution
⑬ Main motor brake

Fig.16

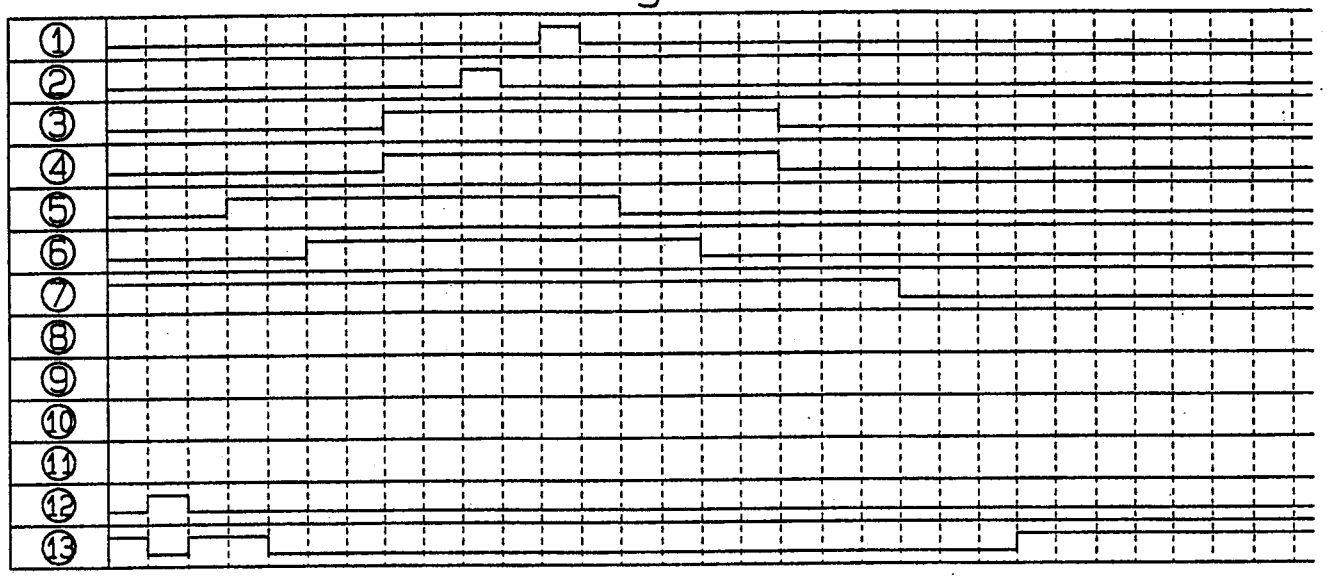

① Normal revolution of phase control motor (min.direction)
② Reverce revolution of phase control motor (max.direction)
③ Phase controlling electromagnetic cluch
④ Phase controlling electromagnetic brake
⑤ Transfer cylinder segment lock electromagnetic valve (ON: release)
⑥ Transfer cylinder lock pin electromagnetic valve (ON: immobilize)
⑦ Sheet guide electromagnetic valve (ON: doble side)
⑧ Holder open/close cam electromagnetic valve (single side)
⑨ Holder open/close cam electromagnetic valve (double side)
⑩ Holder reversing cam electromagnetic valve (single side)
⑪ Holder reversing cam electromagnetic valve (double side)
⑫ Main motor normal revolution
⑬ Main motor brake

SHEET TRANSFERRING APPARATUS FOR PRINTING MACHINE

BACKGROUND OF THE INVENTION

1. Field of the Invention

The present invention relates to a sheet-fed printer employed for an offset press, more particularly to a sheet transferring mechanism which transfers a sheet between a plurality of printing units so as to perform multiple color press on a single surface of the sheet and a single color press on both surfaces of the sheets.

2. Description of the Related Art

Printed matters including pamphlets and catalogs are often printed using offset presses. The offset press is capable of multi-color printing and also well suited for mass printing. Sheet-fed printers, to which printing paper sheets of the same size are fed one by one to carry out offset printing, are widely employed. Such type of sheet-fed offset press is provided with a pair of impression cylinders 220, with a supply cylinder 223 being interposed therebetween via first and second feed cylinders 221,222, as shown in FIG. 24. The supply cylinder 223 has a diameter twice as great as those of the other cylinders 220,221,222.

In a mode where printing is to be applied on both surfaces of the paper Pa (double-surface printing mode or a single color press mode), the paper Pa retained on the right impression cylinder 220 is first printed on the top side by a right blanket cylinder 224*a*. The thus printed paper Pa retained on the supply cylinder 223 is fed through the first feed cylinder 221 to the supply cylinder 223 with the printed surface facing outward and then grasped at the front edge by grippers 230. The paper Pa is then grasped at the rear edge by a plurality of holders 225 arranged in the axial direction of the second feed cylinder 222. The paper Pa is fed further to the second feed cylinder 222 with the printed surface still facing outward to be turned over onto the left impression cylinder 220 and printed on the back side by a left blanket cylinder 224*b*.

In the sheet-fed printer having such reversing mechanism, when the printing paper is to be replaced with sheets of a different size, the locations of the front segment 223*a* and the rear segment 223*b* relative to the supply cylinder 223, i.e. the angle formed between the segments 223*a*, 223*b* and the axis of the supply cylinder 223 is adjusted, in such a way that the rear edge of the paper Pa may coincide with the suction heads 226 of the supply cylinder 223.

The phase of the second feed cylinder 222 relative to the supply cylinder 223 is also adjusted so that the holders 225 provided on the second feed cylinder 222 may securely grasp the rear edge of the paper Pa, and further the timing that the grippers 320 release the paper Pa is adjusted. This timing is decided by a cam ring (not shown) of the supply cylinder 223. The cam ring is fitted on the cylinder shaft of the supply cylinder 223, and a cam (not shown), which causes the grippers to release the paper Pa, is attached to the lateral surface of the cam ring. The phase of the supply cylinder 223 is adjusted by turning the cam ring in accordance with the phase adjustment of the second feed cylinder 222.

Further, as shown in FIG. 25, a pair of cams 227,228 which carry out opening and closing motions of the holders 225 are fitted side by side coaxially on the same shaft. These cams 227,228 have different cam surfaces respectively. One of them is a first control cam 227 for shifting the holding position of the paper Pa by the holders 225, and the other is a second control cam 228 for multiple color printing which is used for stably maintaining the holding position. By shifting a cam follower 229 between the position indicated by the solid line and the position indicated by the dash-dotted line, the cam follower 229 can selectively be engaged with one of the control cams 227,228. In the double-surface printing mode, the rear edge of the paper Pa must be grasped by the holders 225 provided on the second feed cylinder 222, when the paper Pa is forwarded from the supply cylinder 223 to the second feed cylinder 222; whereas, in a single-surface multiple color printing mode (or a multiple color press mode), the front edge of the paper Pa must be grasped by the holders 225. Accordingly, in order to switch from the single-surface multiple color printing mode to the double-surface printing mode, the cam follower 229 is engaged with the first control cam 227 to shift the paper holding position of the holders 225.

However, the main motor for driving the respective cylinders in the press must be stopped when the printing mode of the sheet-fed printer having such reversing mechanism, and the angles formed by the front segment 223*a* and the rear segment 223*b* with the axis of the supply cylinder 223 are manually adjusted to the scale corresponding to the size of the paper Pa. Further, the phase of the second feed cylinder 222 relative to the supply cylinder 223 is changed by loosening the bolt fastening, for example, a drive gear (or a driven gear) onto the feed cylinder to shift likewise the fixing position of the drive gear to the scale. The phase of the second feed cylinder 222 is adjusted in such a way that the holders 225 of the second feed cylinder 222 may securely hold the rear edge of the paper Pa. In the phase adjustment of the cam ring of the supply cylinder relative to the supply cylinder 223, the locking of the ring to the supply cylinder is released to turn and adjust the position of the cam ring manually to the scale in accordance with the size of the paper Pa. Further, the shifting of the paper holding position of the holders 225 is carried out by shifting manually the position of the cam follower 229.

As described above, the angle adjustment between the front segment 223*a* and the rear segment 223*b* in the supply cylinder 223, phase adjustment of the second feed cylinder 222, phase adjustment of the cam ring of the supply cylinder and shifting of the position of the cam follower 229 must totally be carried out manually. Accordingly, the mode switching from the single-surface multiple color printing to the double-surface printing or the paper size changing incurs a considerable loss of time, and further a number of defective prints are liable to occur due to mishandling in the switching operation.

SUMMARY OF THE INVENTION

The present invention was accomplished in view of the problems inherent in the prior art, and it is an objective of the invention to provide a sheet reversing mechanism for a sheet-fed printer, in which the time required for the printing mode switching can be reduced, and also mishandling in the switching operation can be prevented.

In order to attain the intended objects, in the printer of the present invention, there is provided a sheet-fed printer in which the sheet printed on one side by a first printing unit is transferred to a second printing unit based on the operation of a transfer mechanism so as to carry out double-surface printing or multiple color single-surface printing of the sheet. The transfer mechanism includes a feed cylinder disposed rotatably between the first printing unit and the second printing unit. The feed cylinder has a plurality of holders on the circumference thereof and is driven by a drive source. A power transmission mechanism for transmitting the power of the drive source to the feed cylinder is provided between the feed cylinder and the drive source. The power transmission mechanism is provided with a rotary drive member connected to the drive source, a rotary driven member connected to the feed cylinder and a phase adjusting mechanism for adjusting the phases of these two rotary members.

BRIEF DESCRIPTION OF THE DRAWINGS

The features of the present invention that are believed to be novel are set forth with particularity in the appended claims. The invention, together with the objects and advantages thereof, may best be understood by reference to the following description of the preferred embodiments together with the accompanying drawings in which:

FIG. 12 is a timing chart corresponding to the switching operation of the reversing mechanism in accordance with the switching from the single-surface two-color printing mode to the double-surface single-color printing mode;

FIG. 14 is a timing chart showing the switching operation of the reversing mechanism in accordance with the switching from the double-surface single-color printing mode to the single-surface two-color printing mode;

FIG. 16 is a timing chart showing the adjusting operation in the reversing mechanism in the paper size change mode;

DETAILED DESCRIPTION OF THE PREFERRED EMBODIMENTS

First Embodiment

One embodiment of the reversing mechanism employed in an offset press, in which printing can be carried out by switching between the single-surface two-color printing mode and double-surface single-color printing mode, will be described referring to the attached drawings.

Figure 1:
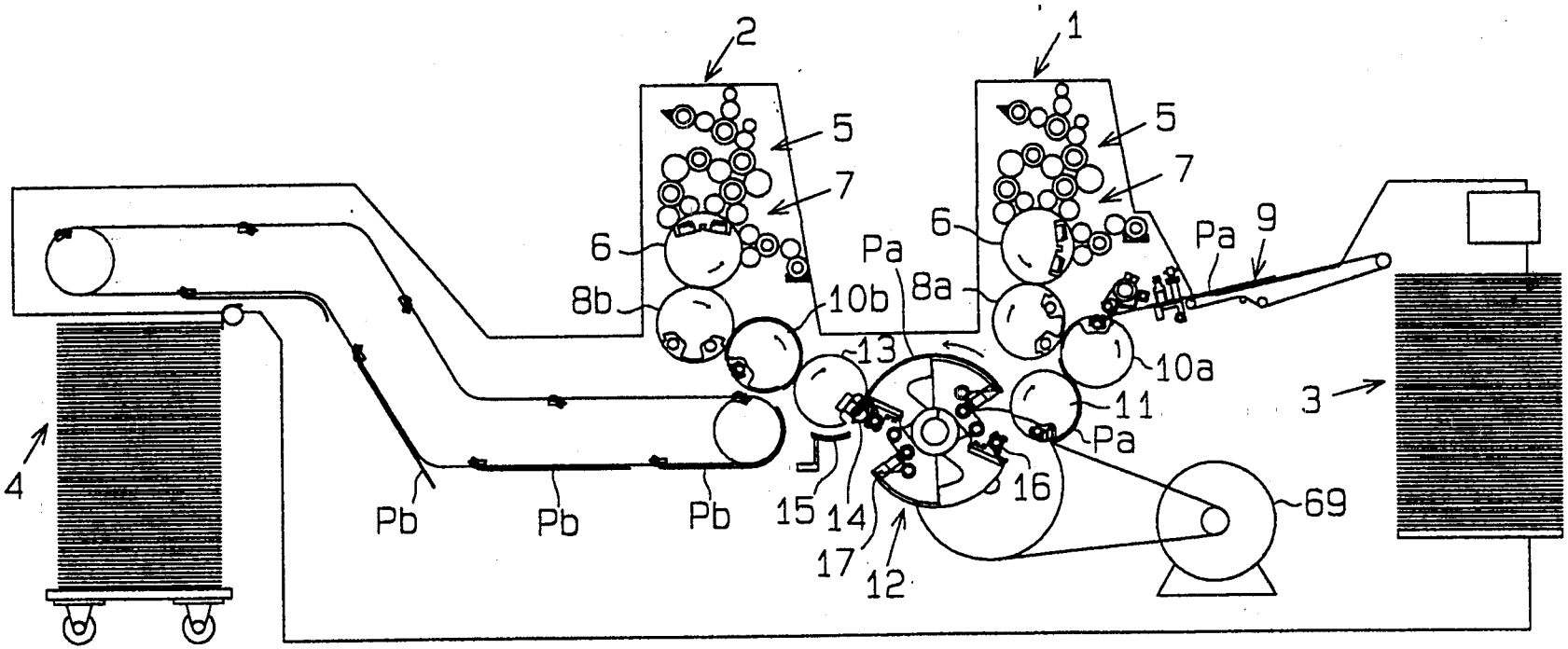
FIG. 1 shows in front view the reversing mechanism employed in an offset press, according to one embodiment of the invention, which is shiftable between the single-surface two-color printing mode and the double-surface single-color printing mode.
Figure 2:
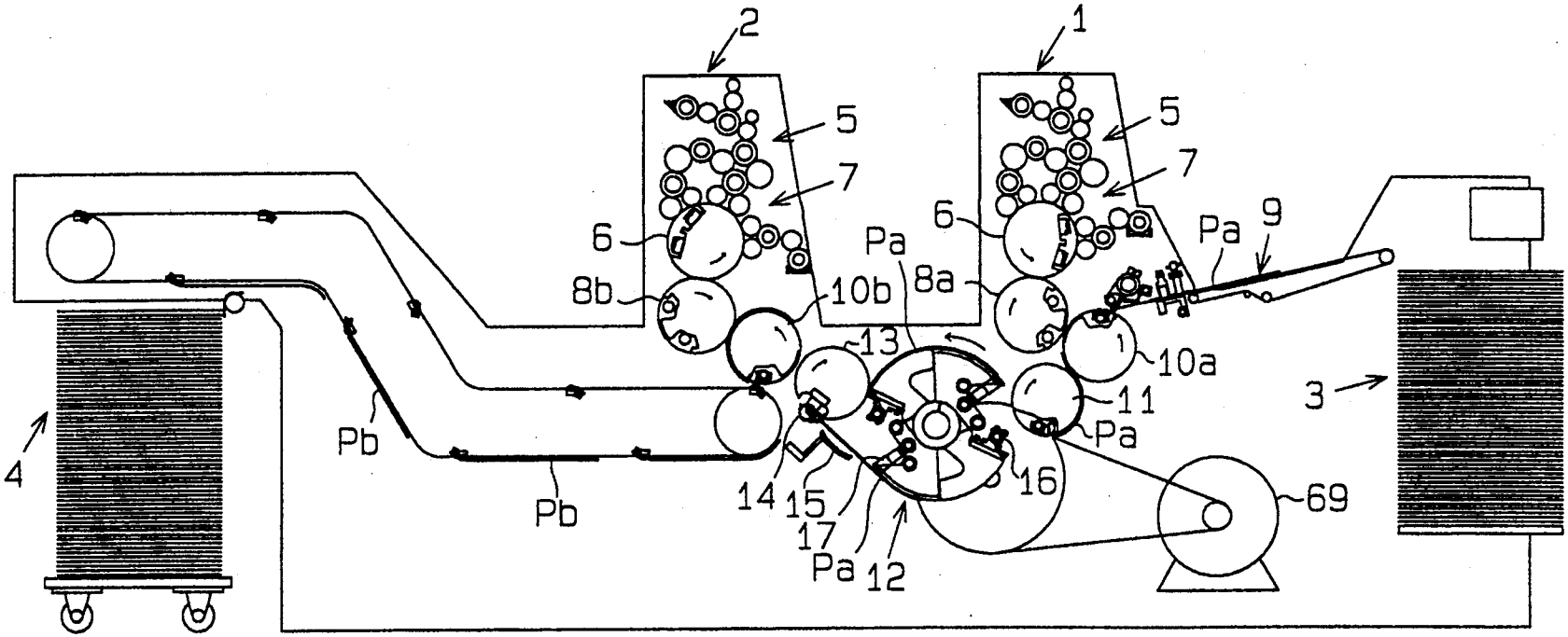
FIG. 2 shows in front view the offset press shown in FIG. 1, which is switched to the double-surface single-color printing mode.

The offset press shown in FIGS. 1 and 2 is provided with two printing units, a first printing unit 1 and a second printing unit 2. A feeder 3 is disposed adjacent to the first printing unit 1, while a delivery device 4 is disposed adjacent to the second printing unit 2.

In each printing unit 1 or 2, an ink is fed to a plate cylinder 6 via ink distribution rollers 5, and water is also fed to the plate cylinder 6 via water distribution rollers 7. The plate cylinder 6 is inked and watered, and the ink and water are transferred to the blanket cylinder 8*a* or 8*b*. A sheet of paper Pa is fed from the feeder 3 via a sheet feeder 9 to an impression cylinder 10*a* or 10*b*.

As shown in FIG. 1, in the mode where two-color printing is carried out on one surface of the sheet, the paper Pa retained on the circumference of the right impression cylinder 10*a* is brought into contact with the circumference of the right blanket cylinder 8*a* to be subjected to a first color printing. The blanket cylinder 8*a* is rotated as the impression cylinder 10*a* revolves to apply printing on the entire surface of the paper Pa. The thus printed paper Pa is fed with the printed surface facing outward via a first feed cylinder 11 to a transfer cylinder 12 and grasped at the front edge thereof by grippers 16. The paper Pa locating on the transfer cylinder 12 is caught at the front edge thereof by a plurality of holders 14 arranged in the axial direction of a second feed cylinder 13 and forwarded onto the second feed cylinder 13 with the printed surface facing inward. The paper Pa is then retained on the left impression cylinder 10*b* with the printed surface facing outward again to be subjected to a second color printing by the left blanket cylinder 8*b*. The cylinders in each unit are mutually connected by a gear mechanism so that they can be rotated under driving of a main motor 69 via the gear mechanism. Incidentally, a sheet guide 15 is disposed substantially horizontally in the single-surface two-color printing mode in order to prevent the rear end portion of the paper Pa from dangling during the process in which the paper Pa is forwarded from the transfer cylinder 12 to the second feed cylinder 13.

Figure 3A:
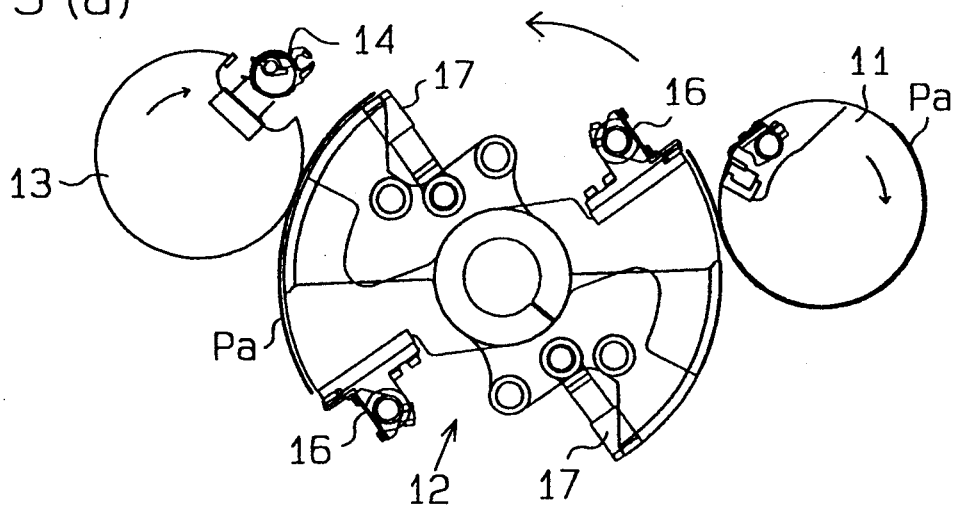
FIGS. 3(*a*) to (*c*) show in enlarged view how a sheet is fed by the supply cylinder in the offset press shown in FIG. 2.
Figure 3B:
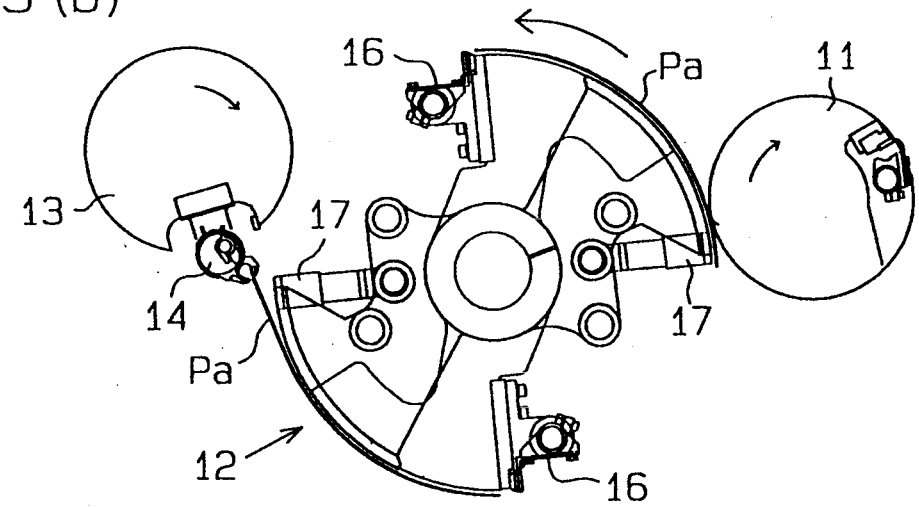
Figure 3C:
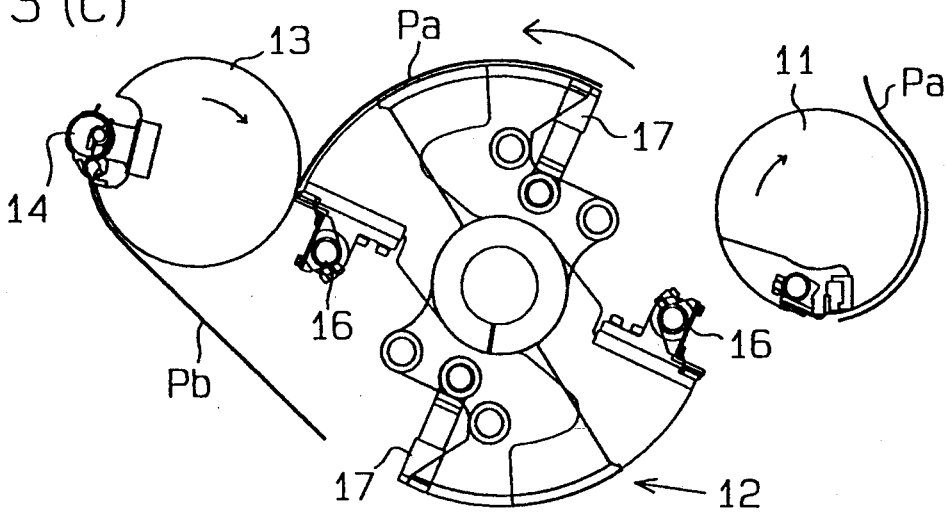

In the mode where single-color printing is carried out on both surfaces of the sheet, the paper Pa retained on the circumference of the right impression cylinder 10*a* is brought into contact with the circumference of the right blanket cylinder 8*a*, as shown in FIGS. 2 and 3, to be subjected to a first color printing. The blanket cylinder 8*a* is rotated as the impression cylinder 10*a* revolves to apply printing on the entire surface of the paper Pa. The Pa thus printed on the top surface by the blanket cylinder 8*a* is fed with the printed surface facing outward via the first feed cylinder 11 to the transfer cylinder 12, where the front edge of the paper Pa is grasped by the grippers 16 of the transfer cylinder 12 and the rear edge thereof is retained by suction heads 17 of the transfer cylinder 12. After the front edge of the paper Pa retained on the transfer cylinder 12 passes the contact point with the second feed cylinder 13, the rear edge of the paper Pa is caught by the holders 14 of the second feed cylinder 13. As shown in FIGS. 3(*a*), (*b*) and (*c*) of FIG. 3, after the rear edge of the paper Pa is caught by the holders 14, the holders 14 turn on the axis thereof, so that the paper Pa may not be creased. The paper Pa is retained on the second feed cylinder 13 with the printed surface facing outward and then transferred to the left impression cylinder 10*b* with the printed surface facing inward to be subjected to printing on the rear surface by the left blanket cylinder 8*b*. Incidentally, it is apparent that the sheet guide 15 in FIG. 2 is pivoted on one end portion slightly downward compared with FIG. 1 where single-surface printing is carried out and assuming the retracted posture, so that it may not interfere with the paper Pa being fed. The thus printed paper Pa is forwarded to the delivery device 4.

Next, a mechanism for automatically adjusting the span between the grippers 16 and the suction heads 17 along the circumference of the transfer cylinder 12, when the single-surface two-color printing mode is to be switched to the double-surface single-color printing mode or when the paper size is to be changed in the latter mode, will be described. While the automatic adjusting mechanism is driven by a control unit shown in FIG. 9, details thereof will be described later.

Figure 4:
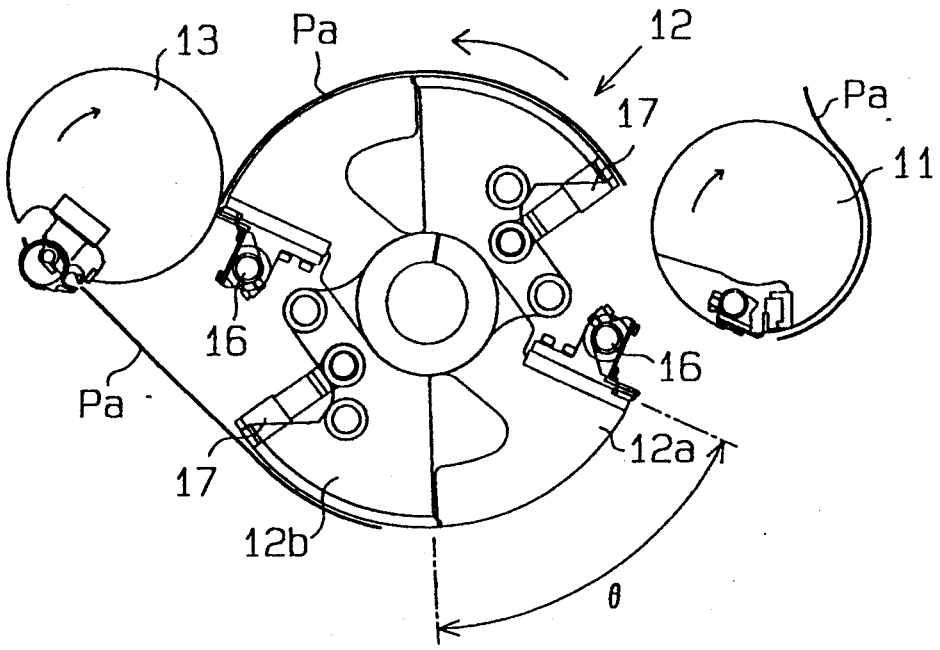
FIGS. 4 (*a*) and (*b*) show in enlarged view the situations where the angle between the front segment and the rear segment is changed depending on the size of the paper.
Figure 4:
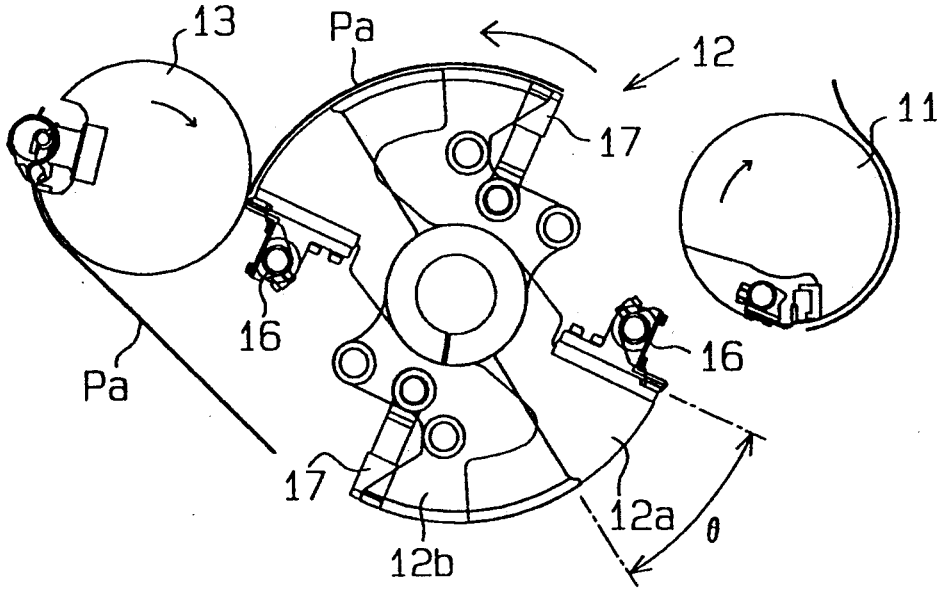

As shown in FIGS. 4(*a*) and (*b*), the transfer cylinder 12 consists of a front segment 12*a* and a rear segment 12*b*. When the double-surface printing is to be carried out as described above, the rear edge of the paper Pa must securely be retained on the transfer cylinder 12 so that the rear edge of the paper Pa may be caught by the holders 14 of the second feed cylinder 13. Accordingly, the span between the grippers 16 and the suction heads 17 along the circumference of the transfer cylinder 12 is adapted to be automatically adjusted such that the rear edge of the paper Pa may coincide with the location of the suction heads 17 corresponding to the size of the paper. As shown in FIG. 4 (*a*), when the size of the paper is large, the front segment 12*a* and the rear segment 12*b* of the transfer cylinder 12 are set apart from each other to form a great angle $\theta$ therebetween and provide a great span between the grippers 16 and the suction heads 17. As shown in FIG. 4 (*b*), when the size of the paper is small, these two segments are set to overlap each other to form a small angle $\theta$ and provide a reduced span between the grippers 16 and the suction heads 17.

Figure 5:
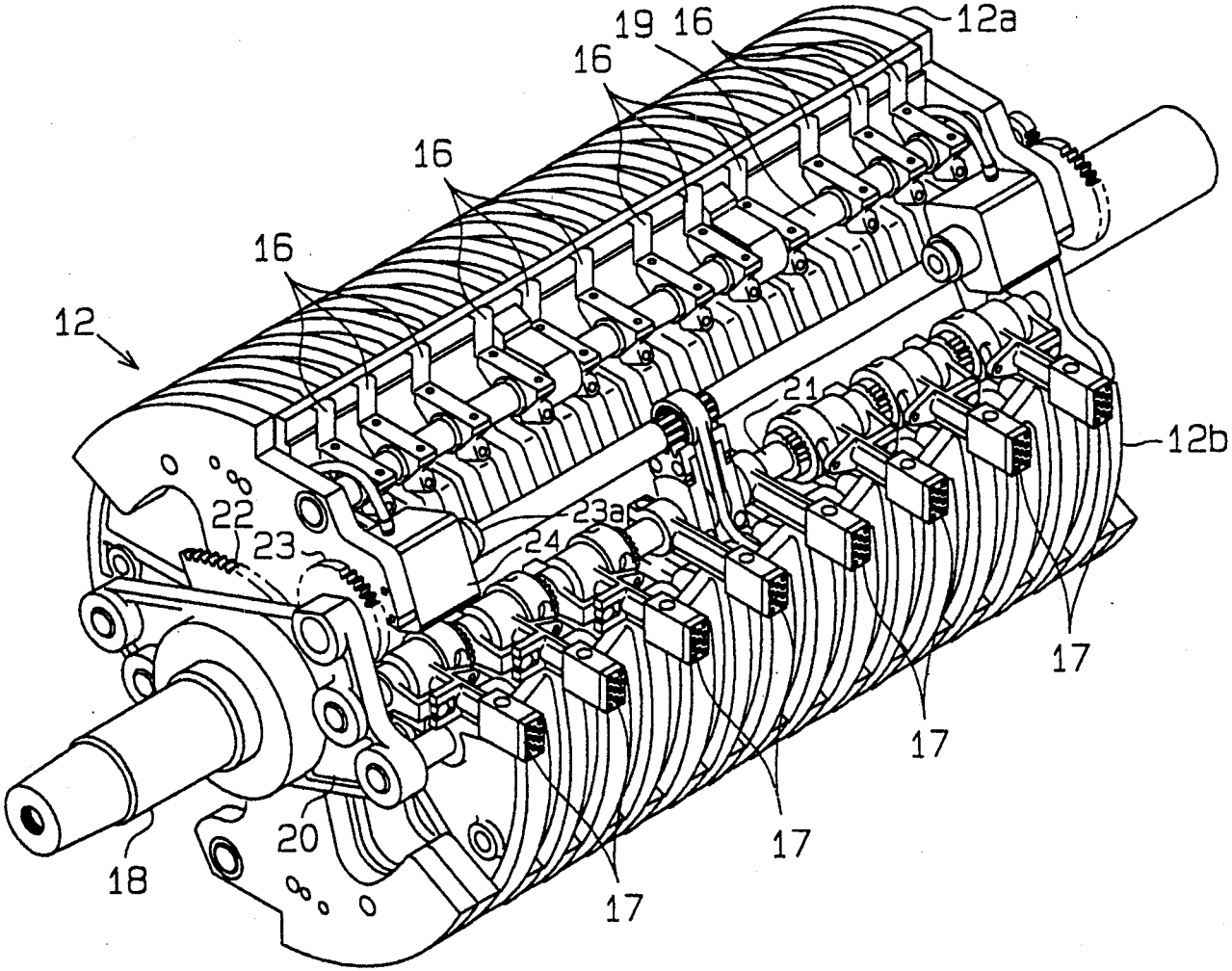
FIG. 5 shows in perspective view the supply cylinder.

As shown in FIG. 5, the front segment 12*a* is fitted on a cylinder shaft 18 to be able to rotate integrally therewith. A support shaft 19 is extended axially at an outer position of the front segment 12*a*. The grippers 16 are secured onto the support shaft 19, and they are let open or closed together as the support shaft 19 is turned. The grippers 16 can catch the front edge of the paper Pa printed on the top side thereof.

The rear segment 12*b* is retained on the cylinder shaft 18 together with a segment holder 20 so as to be rotatable relative to the cylinder shaft 18. The rear segment 12*b* has a support shaft 21 extended at an outer position thereof, on which the suction heads 17 are fitted. These suction heads 17 suck and retain thereon the rear edge of the paper Pa.

Figure 17:
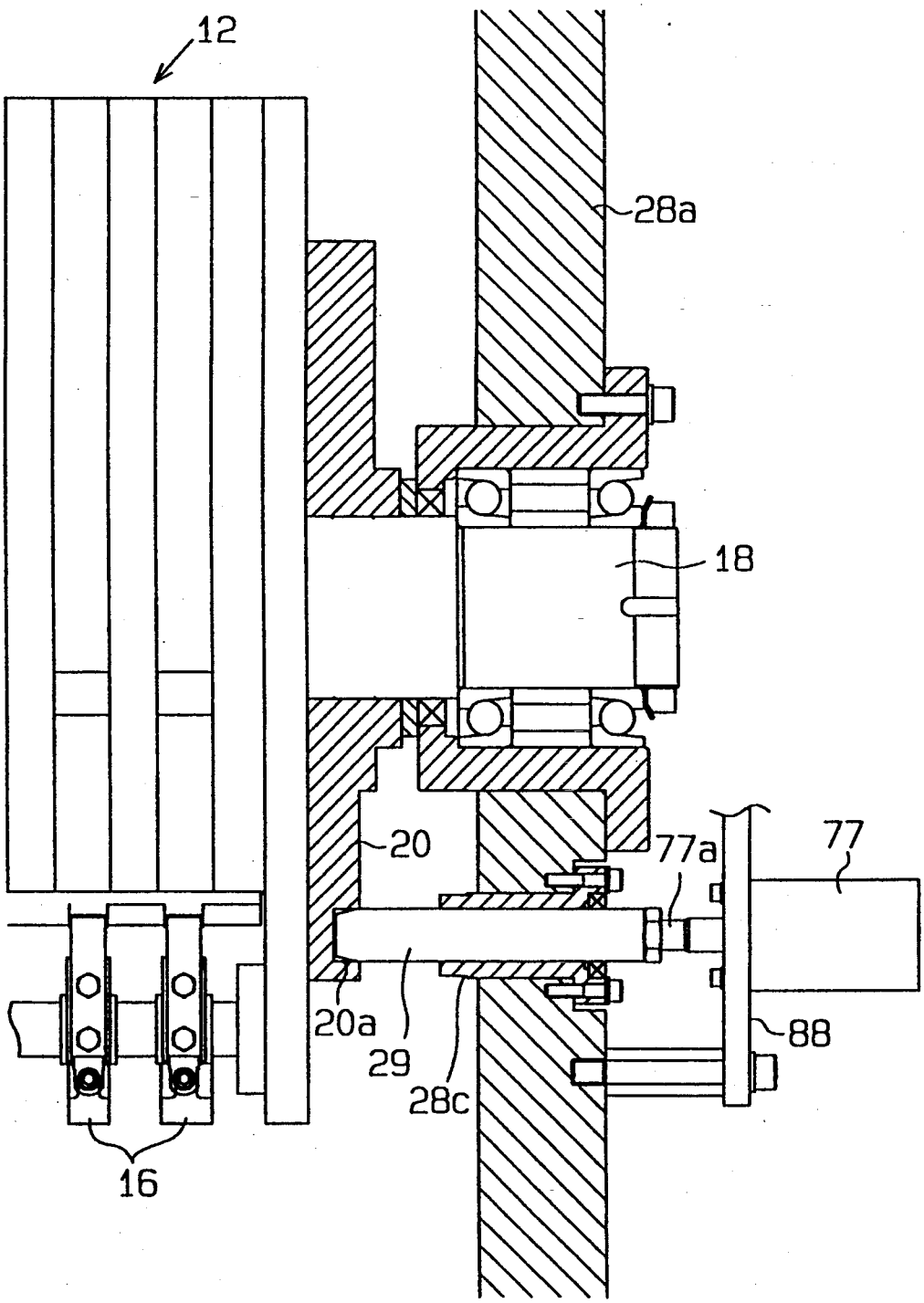
FIG. 17 shows in cross section the major portions of the locking mechanism provided near one end of the cylinder shaft of the transfer cylinder.

The front segment 12*a* and the rear segment 12*b* are linked to each other via a sector gear 22 fixed to the latter and a pinion gear 23 fitted on the former. As shown in FIG. 17, the cylinder shaft 18 is rotatably supported between frames 28*a*,28*b* (only the frame 28*a* is shown in FIG. 17). A lock pin cylinder 77 is mounted on the outer side of the frame 28*a* via a bracket 88. A lock pin 29 screwed into the end portion of the rod 77*a* of the cylinder 77 is slidably fitted in a sleeve 28*c* penetrating the frame 28*a*. A recess 20*a* is defined on the segment holder 20, in which the free end portion of the lock pin 29 can be inserted. The rear segment 12*b* can be immobilized with respect to the frame 28*a* by inserting the lock pin 29 into the recess 20*a*.

As shown in FIG. 5, the rotary shaft 23*a* of the pinion gear 23, which is referred to as THOMALOCK (trade name, PAVOT GIKEN K. K.), is inserted to a segment lock 24 having a built-in braking equipment. The rotary shaft 23*a* of the pinion gear 23 is normally locked by the braking equipment in the segment lock 24 to normally prevent the pinion gear 23 from moving on the sector gear 22 and to lock the front segment 12*a* and the rear segment 12*b* with a predetermined angle therebetween. The segment lock 24 is pneumatically driven, and the locking by the braking equipment is released when air is supplied to the segment lock 24. Accordingly, the angle between these two segments 12*a*,12*b* can be adjusted by locking the rear segment 12*b* with the lock pin 29 in this state to turn the cylinder shaft 18 and pivot the front segment 12*a*, whereby the span between the grippers 16 and the suction heads 17 of the transfer cylinder 12 can be adjusted.

Next, the phase adjustment mechanism of the second feed cylinder 13 will be described. In the case of switching from the single-surface two-color printing mode to the double-surface single-color printing mode or of the paper size changing in the latter mode, the phase of the second feed cylinder 13 must be adjusted in order that the holders 14 of the second feed cylinder 13 may securely catch the rear edge of the paper Pa retained on the transfer cylinder 12. Incidentally, the respective members in the phase adjustment mechanism are also driven by the control unit shown in FIG. 9.

Figure 6:
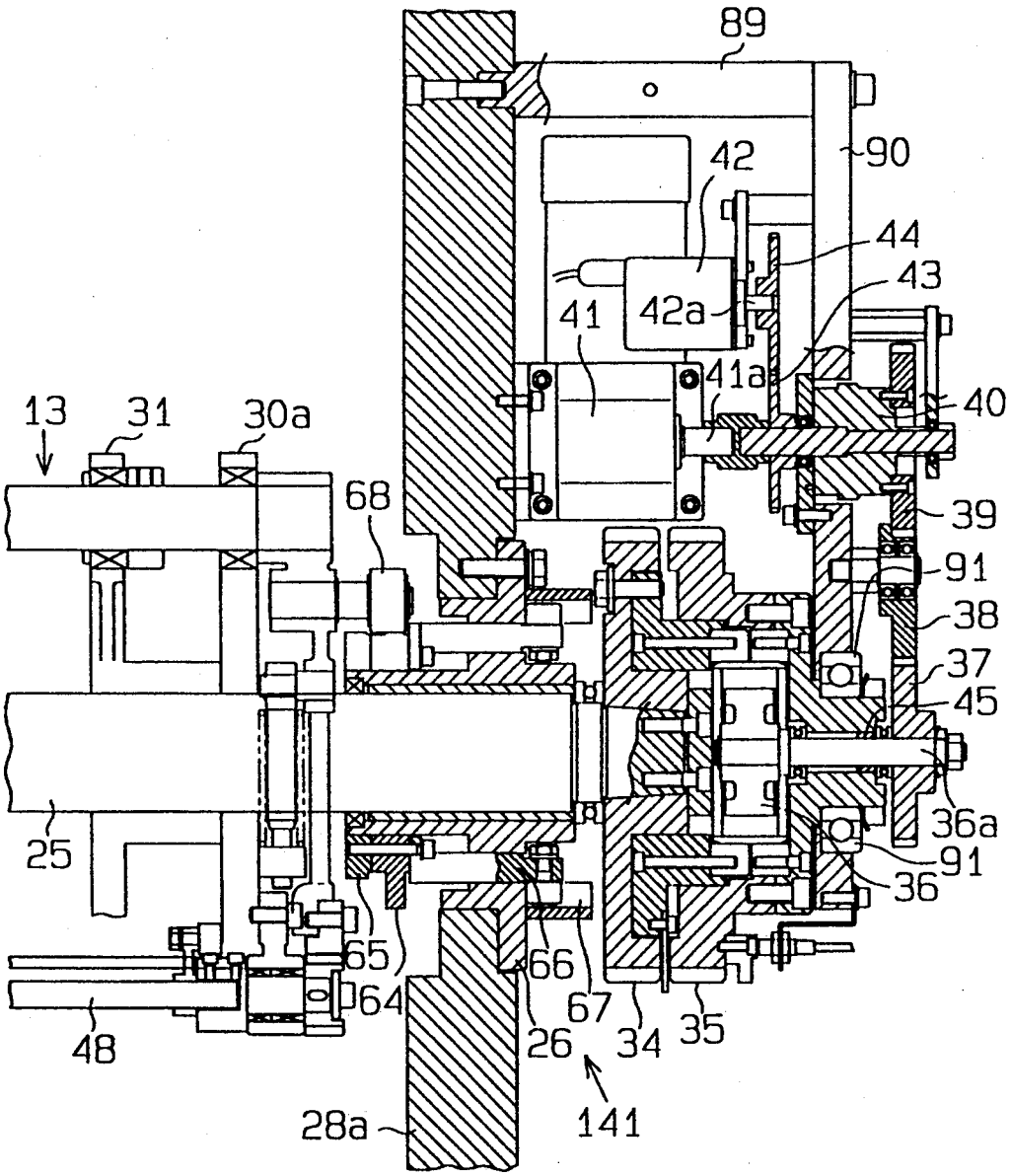
FIG. 6 shows in cross section the major portions of the mechanism for adjusting the phase of the gear in the feed cylinder.
Figure 7:
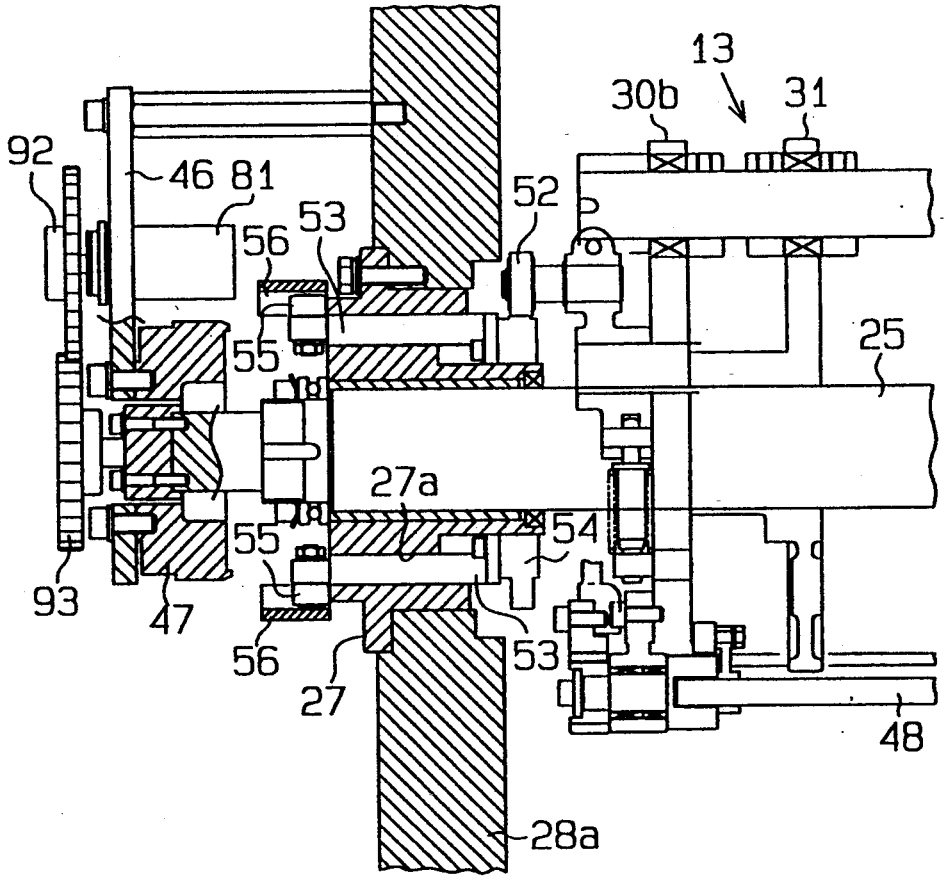
FIG. 7 shows in cross section the major portions of the mechanism for adjusting the phase of the gear in the electromagnetic brake-fitted end of the feed cylinder.
Figure 8A:
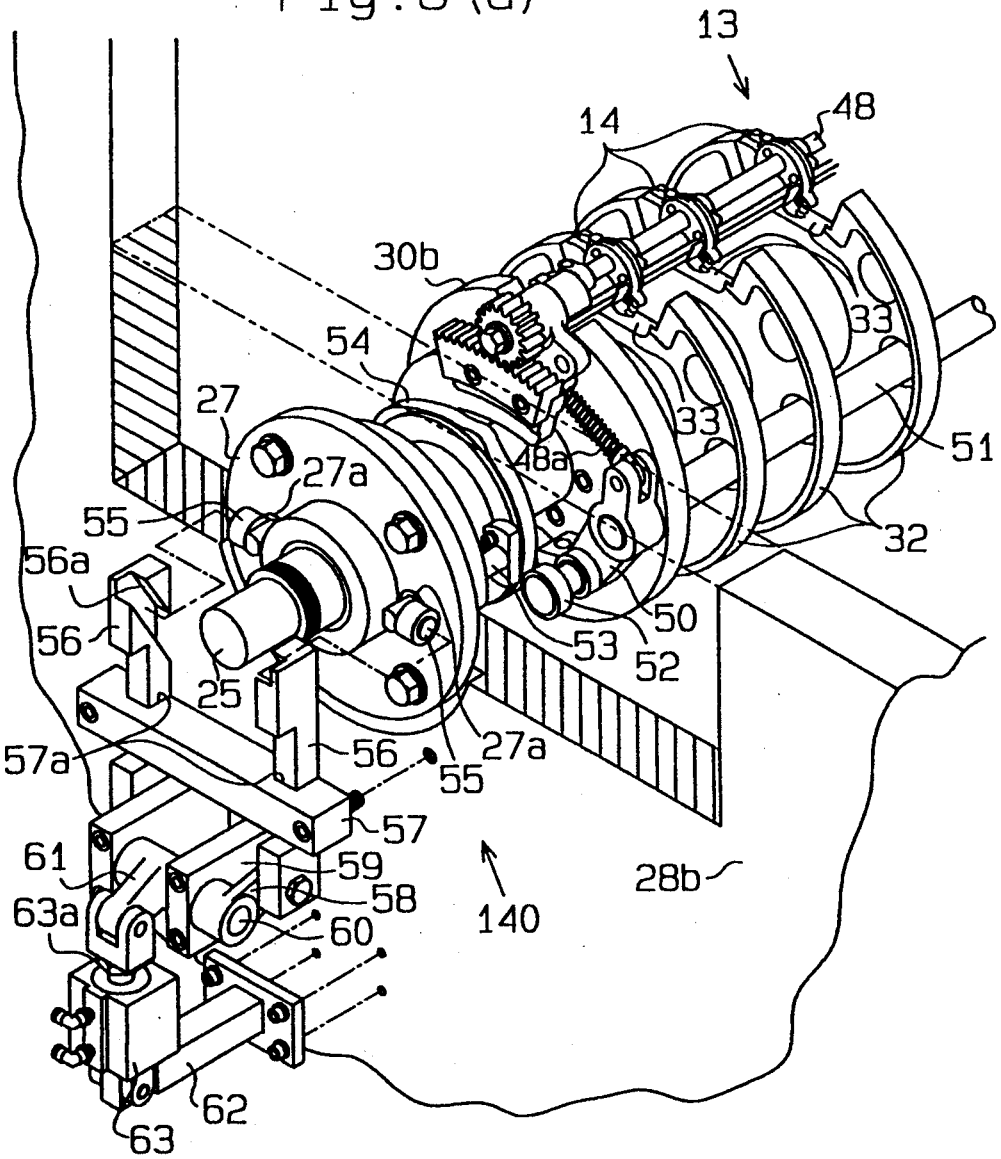
FIG. 8 (*a*) shows in perspective view the cam shifting mechanism in a second feed cylinder, and FIG. 8 (*b*) shows in side view the cam and cam follower of the second feed cylinder.
Figure 8B:
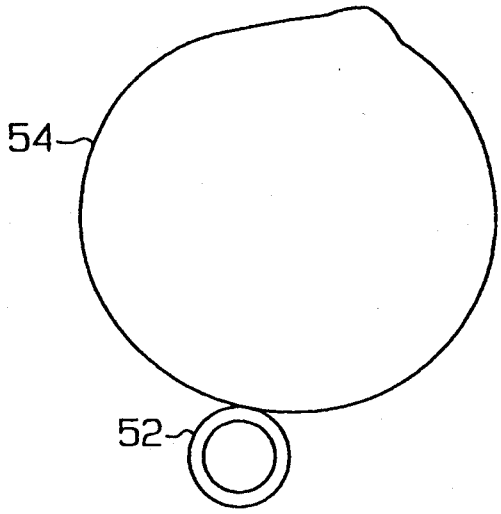

As shown in FIGS. 6 and 7, the main shaft 25 of the second feed cylinder 13 is rotatably supported via a pair of bearings 26,27 between the frames **28*a*,28*b* of the press. A pair of side plates 30*a*,30*b* are fixed on the main shaft 25 at the positions inner than the frames 28*a*,28*b*, respectively, with a predetermined distance therebetween. A plurality of guide pieces 31 are fixed onto the main shaft 25 between the side walls 30*a*,30*b* at equal intervals. The circumferential surfaces of these guide pieces 31 constitute a sheet guide surface 32 (FIG. 8**(*a*)) of the second feed cylinder 13, while the recesses defined in the respective guide piece 31 constitute a groove 33 (FIG. 8(*a*)) of the second feed cylinder 13. Further, a plate-like support 90 is fixed on the outer side of the frame **28*a* via a bracket 89**.

A driven gear 34 is fitted on the right end of the main shaft 25 to be rotatable integrally therewith. A drive gear 35 is supported on the support 90 via a bearing 91 to be rotatable relative to the support 90. The drive gear 35 is connected via a decelerator 36, Harmonic Differential Unit (trade name, Harmonic Differential), to the driven gear 34. The driving force of the main motor 69 is transmitted to the drive gear 35 via an intermediate gear (not shown) and further therefrom to the rollers 5 and the respective cylinders in the second printing unit 2 via the driven gear 34. The driving force of the main motor 69 is also transmitted to the rollers and cylinders in the first printing unit 1 via another gear mechanism.

The decelerator 36 is equipped with a phase adjustment shaft **36*a*, so that the phase of the drive gear 35 with respect to the driven gear 34 can be adjusted by revolving the shaft 36*a*. Under normal operation of the press, the adjustment shaft 36*a* is immobilized relative to the drive gear 35, and the rotation transmission ratio of the drive gear 35 to the driven gear 34** is 1:1.

A phase control motor 41 is mounted on the frame **28*a*. The phase adjustment shaft 36*a* of the decelerator 36 penetrates the support 90 and protrudes outward therefrom, with a gear 37 being fixed onto the outer end of the adjustment shaft 36*a*. The gear 37 is connected to the shaft 41*a* of the phase adjustment motor 41, so as to be driven thereby, via a plurality of gears 38,39 mounted rotatably onto the support 90 and an electromagnetic clutch 40. A gear 43 is fitted on the shaft 41*a*. An encoder 42 is fixed on the inner surface of the support 90, and a gear 44, which is provided on the input shaft 42*a* of the encoder 42, is engaged with the gear 43. The rotation of the motor 41 is detected in accordance with the pulse signal output from the encoder 42 as it rotates, whereby the phase change of the drive gear 35 with respect to the driven gear 34 is detected. Further, a brake 45 is provided between the drive gear 35 and the phase adjustment shaft 36*a*, so as to prevent the phase adjustment shaft 36*a*** from rotating by application of a very small force.

As shown in FIG. 7, an electromagnetic brake 47 is disposed via a bracket 46 on the frame **28*b* on which the main shaft 25 is rotatably supported at the left end portion. The electromagnetic brake 47 is fitted on the main shaft 25, and the rotation of the main shaft 25 is stopped by actuating the electromagnetic brake 47. A second unit timing detector 81, which is a resolver having a gear 92, is mounted onto the bracket 46. The timing detector 81 is connected to the end of the main shaft 25 via gears 92,93 so as to be driven thereby. The reference position of the second feed cylinder 13 in the second printing unit 2 is detected by the timing detector 81. When the second feed cylinder 13 is at the reference position, a cam 54 thereof (to be described later) locates at the position shown in FIG. 8** (*b*).

When the phase of the second feed cylinder 13 is to be adjusted, the electromagnetic brake 47 stops rotation of the main shaft 25 to stop revolution of each cylinder in the second printing unit 2. The electromagnetic clutch 40 shown in FIG. 6 is then actuated in this state to connect the shaft **41*a* of the motor 41 to the gear 39, and the revolution of the motor 41 is transmitted to the adjustment shaft 36*a* via gears 39,38,37. The phase of the drive gear 35 relative to the driven gear 34 can be adjusted by rotating the shaft 36*a***.

Next, a pair of cam shifting mechanisms 140,141 for opening or closing or pivoting the holders 14 of the second feed cylinder 13, in the mode switching from single-surface two-color printing to the double-surface single-color printing, will be described. These cam shifting mechanisms 140,141 are also driven by the control unit shown in FIG. 9.

To describe first the cam shifting mechanism 140, a support shaft 48, which is extended along the groove 33, is pivotally supported between the side plates **30*a*,30*b*. The holders 14 are fixed to the support shaft 48. A shaft 51 is pivotally disposed between the side walls 30*a*,30*b*, and a lever 50 for opening and closing the holders 14 is also pivotally disposed on the outer side of the side wall 30*a*. A first end portion of the support shaft 48 protruding outward from the side wall 30*b* is connected to the lever 50 via a crank 48*a*. A first cam follower 52 is rotatably disposed on an end portion of the lever 50. The holders 14 are let open or closed by pivoting the lever 50**.

A pair of holes **27*a* are formed in the left bearing 27 of the main shaft 25, in which pins 53 are slidably fitted, respectively. An annular cam 54 is fitted to surround the boss of the bearing 27 at the inner ends of the pins 53. The cam 54 is used for retaining the paper Pa by the holders 14 of the second feed cylinder 13, and the first cam follower 52 is disposed to be movable along the cam surface. Second cam followers 55 are rotatably disposed on the outer end portions of the pins 53. A pair of vertical guide grooves 57*a* are defined on a guide 57 fixed to the frame 28*b*, in which cam shifting plates 56 are slidably fitted respectively. A slant cam groove 56*a* is defined at the upper end portion of each cam shifting plate 56. The cam followers 55 are accommodated in the cam grooves 56*a* of the cam shifting plates 56. The pins 53 are reciprocated in the axial direction of the second feed cylinder 13 by reciprocating the cam plates 56** in the longitudinal directions.

A bracket 59 is fixed onto the frame **28*b*, and a shaft 60 is pivotally supported on the bracket 59. A pair of first levers 58 are attached to both end portions of the shaft 60. Further, a second lever 61 is fitted at the middle of the shaft 60 to extend in the direction opposite to those of the first levers 58. The first levers 58 are pivotally connected to the ends of the cam shifting plates 56 respectively. Further, a cam cylinder 63 for opening and closing the holders 14 is fixed via a support pin 62 to the frame 28***b*, and the outer end of the second lever 61 is pivotally connected to the cylinder rod 63*a* of the cam cylinder 63.

Accordingly, when air is supplied to the cam cylinder 63 to protrude the cylinder rod 63*a*, the cam shifting plates 56 are allowed to slide down via the levers 61,58. The cam 54 is thus shifted outward in the axial direction of the second feed cylinder 13 via the cam grooves 56*a*, the cam follower 52 and the pins 53, whereby the cam 54 is disengaged from the cam follower 52.

When the air is exhausted from the cam cylinder 63, the cam shifting plates 56 slide upward. As the cam shifting plates 56 slide, the cam 54 is shifted inward in the axial direction of the second feed cylinder 13, whereby the cam 54 is engaged with the cam follower 52.

As shown in FIG. 6, another cam shifting mechanism 141 having a holder reversing cam cylinder 78 (see FIG. 9) is provided at the right end portion of the main shaft 25. Since the cam shifting mechanism 141 is of substantially the same constitution as the cam shifting mechanism 140, detailed description thereof will be omitted, and only different aspects will be described.

A pair of annular cams 64, 65 are fitted on the boss of the bearing 26 disposed in the fame 28*a*. One cam 65 is for opening and closing the holders 14 which are used in single-surface printing, and the other cam 64 is for reversing the position of the holders 14 in double-surface printing. Pins 66 which are slidable in the axial direction are disposed on the bearing 27, and the cams 64,65 are linked to the pins 66 and moved in the axial direction of the second feed cylinder 13 in accordance with the movement of cam shifting plates 67 corresponding to the cam shifting plates 56 of the cam shifting mechanism 140, whereby a cam follower 68 is selectively engaged with the cam 64 or 65.

Next, the mechanism for automatically adjusting the angles formed between the front segment and the rear segment of the transfer cylinder, the mechanism for controlling the phase of the feed cylinder and the control unit for controlling to pivot or open and close the holders of the second feed cylinder will be described.

Figure 9:
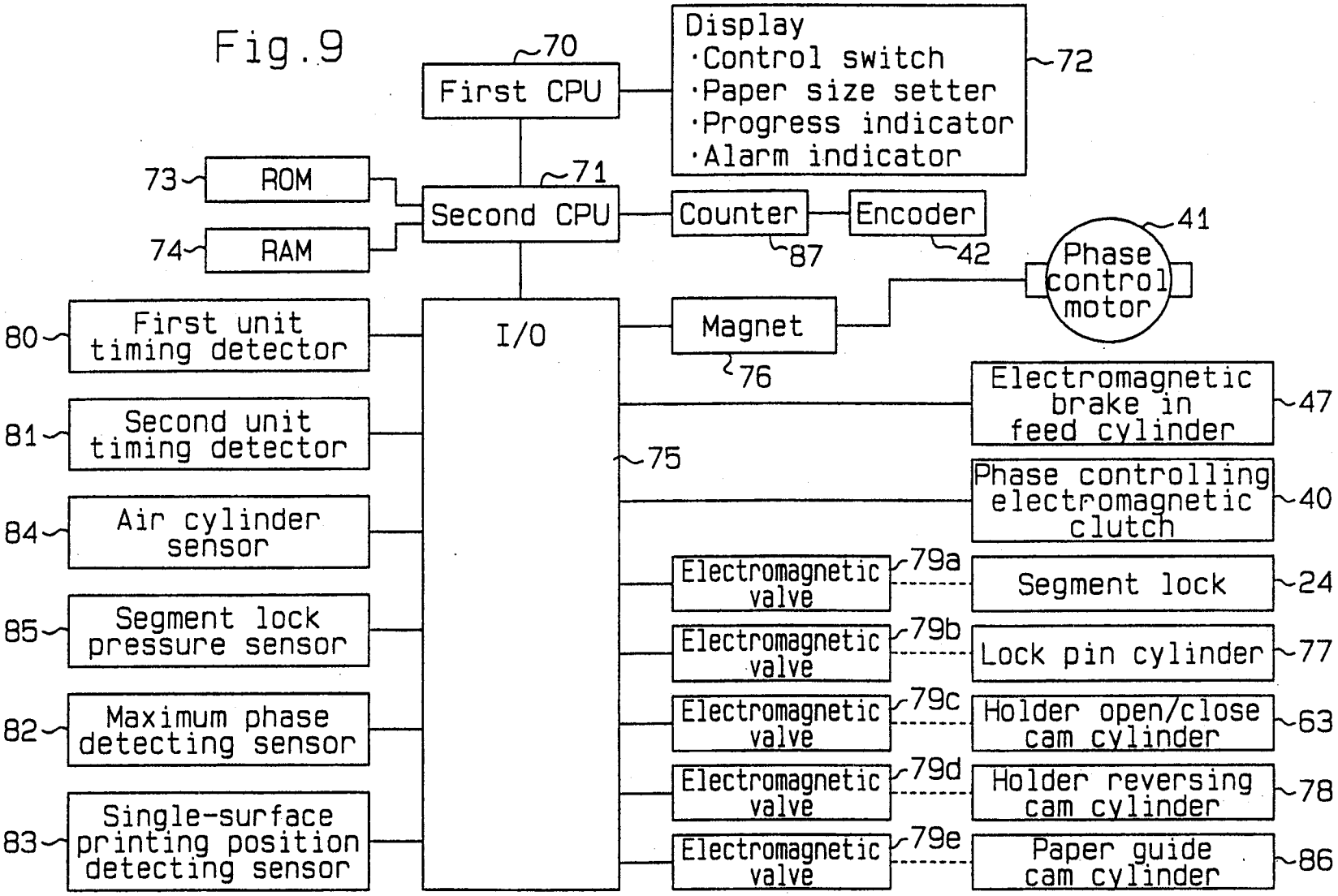
FIG. 9 is a block chart of the control system in the offset press.

As shown in FIG. 9, the control unit is provided with two CPUs (central processing units) 70,71. A display 72 is connected to the first CPU 70 for display. The display 72 is provided with control switches or an input section such as for paper size input device etc. The control switches are provided on the touch panel of the display 72, and the desired switch on the panel can selectively be operated. The paper size input device has ten keys provided on the display 72 and is used for inputting the longitudinal size of the paper Pa. The display 72 is further provided with a function of literally displaying real time the progress of the operation or an alarm function for displaying malfunction such as failure.

To the second CPU 71 are connected a ROM (read only memory) 73 in which a program for contorting the operation of the press is stored and a RAM (random access memory) 74 for temporarily storing the data etc. in the course of arithmetic processing. The encoder 42 is also connected to the second CPU 71 via a counter 87. Further, an input/output (I/O) unit 75 is connected to the second CPU 71.

The phase control motor 41 is connected to the I/O unit 75 via a magnet 76 for controlling the revolution direction of the motor 41. Detectors 80,81 and a plurality of sensors (first to fourth sensors) 82,83,84,85, for detecting the operational timing of the first and second printing units 1,2, respectively, are further connected to the I/O unit 75. The electromagnetic brake 47 in the feed cylinder and the electromagnetic clutch 40 for phase control are also connected to the I/O unit 75, with various actuators being further connected thereto via electromagnetic valves 79*a*,79*b*,79*c*,79*d*,79*e*, respectively. The actuators include the segment lock 24 of the transfer cylinder, the rock pin cylinder 77, the cam cylinder 63 for opening and closing the holders 14, the cam cylinder 78 for pivoting the holders 14 and the cam cylinder 86 for driving the sheet guide cam.

The timing detector 80, shown only in FIG. 9, in the first printing unit 1 is of a cam positioner and is mounted to a certain cylinder in the first printing unit 1. The timing detector 80 in the first printing unit 1 and the timing detector 81 in the second printing unit 2 are also utilized by specifying the timing of operating the lock pin 29. The first sensor 82 detects the position where the second feed cylinder 13 is approached to the maximum phase. The second sensor 83 detects whether or not the second feed cylinder 13 is at the position corresponding to the single-surface printing mode.

For adjusting the phase of the second feed cylinder 13 by the phase control motor 41, an electric signal is fed from the CPU 71 via the I/O unit 75 to the electromagnetic brake 47 and the electromagnetic clutch 40 to actuate the brake 47 and the clutch 40, and thus the main shaft 25 shown in FIGS. 6 and 7 is locked by the electromagnetic brake 47, and the shaft 41*a* of the motor 41 is connected to the gear 39 by the electromagnetic clutch 40. When another electric signal is fed from the CPU 71 to the motor 41 via the I/O unit 75, the motor 41 rotates. The revolution of the motor 41 is constantly monitored by the encoder 42, and the signal from the encoder is fed via the counter 87 to the CPU 71.

In order to operate the segment lock 24 of the transfer cylinder 12 shown in FIG. 5, the electromagnetic valve 79*a* is actuated by the CPU 71 to supply air to the segment lock 24. By way of the pneumatic pressure, the pinion gear 23 is allowed to rotate to adjust the angle $\theta$ between the front segment 12*a* and the rear segment 12*b*. The pressure change in the segment lock 24 is detected by the fourth sensor 85 to confirm if the operation is securely achieved or not.

When the electromagnetic valve 79*b* is actuated by the CPU 71 in order to operate the lock pin cylinder 77 shown in FIG. 17, air is supplied to the lock pin cylinder 77 to insert the lock pin 29 into the recess 20*a* of the rear segment 12*b*. This operation is confirmed by the third sensor 84. The electromagnetic valves 79*c*,79*d* are further actuated by the CPU 71 to supply air to the cam cylinders 63,78 (see FIG. 9), the cam cylinders 63,78 are operated, and the operations of the respective cam cylinders 63,78 are confirmed by the third sensor 84.

When the electromagnetic valve 79*e* is actuated by the CPU 71, air is supplied to the cylinder 86 for operating the sheet guide to operate the cylinder 86. Then, the sheet guide 15 shifts from the operational position shown in FIG. 1 to the retracted position shown in FIG. 2, so that the sheet guide 15 may be used in the double-surface printing mode.

Next, the mode switching operation in the thus constituted offset press will be described referring to the flow chart and timing chart shown in FIGS. 10 to 16, respectively. This mode switching operation is performed in accordance with the program in the ROM 73 under control of the CPU 71.

Figure 10:
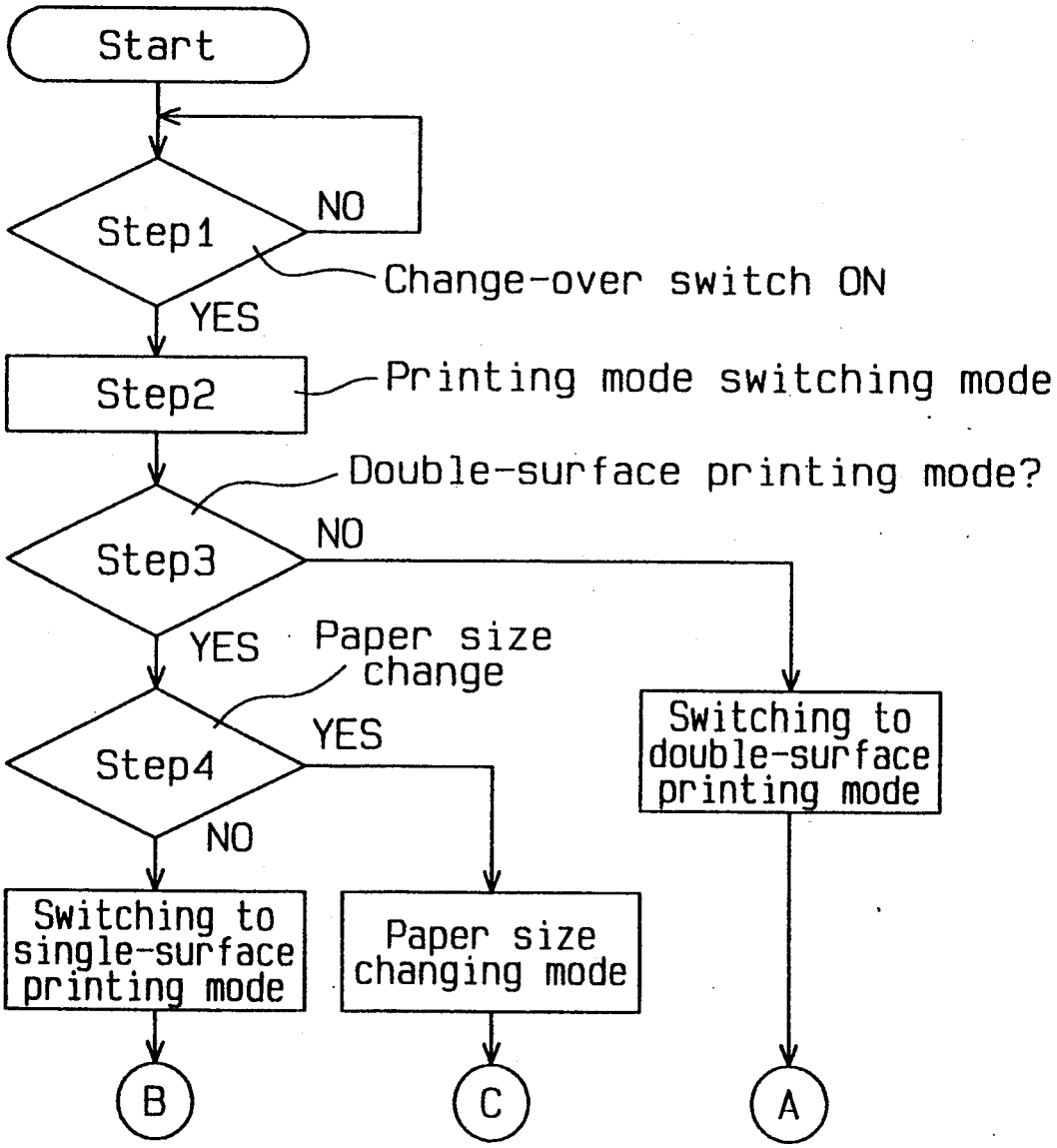
FIG. 10 is a flow chart showing the operation of switching between the double-surface single-color printing mode and the single-surface two-color printing mode, or from such modes to paper size changing operation.

When the switch on the display 72 is turned on (Step 1), the mode for switching the printing modes is called (Step 2), as shown in the flow chart of FIG. 10, and the current status of the press is determined (Step 3). When the current status of the press is the single-surface two-color printing mode, the mode is switched to the double-surface single-color printing mode (A). When the current status of the press is the double-surface single-color printing mode, whether the paper size should be changed or not is determined (Step 4). When the paper size is to be changed, the corresponding routine (C) follows, and when the paper size is not to be changed, the double-surface single-color printing mode is changed to the single-surface two-color printing mode (B).

Figure 11:
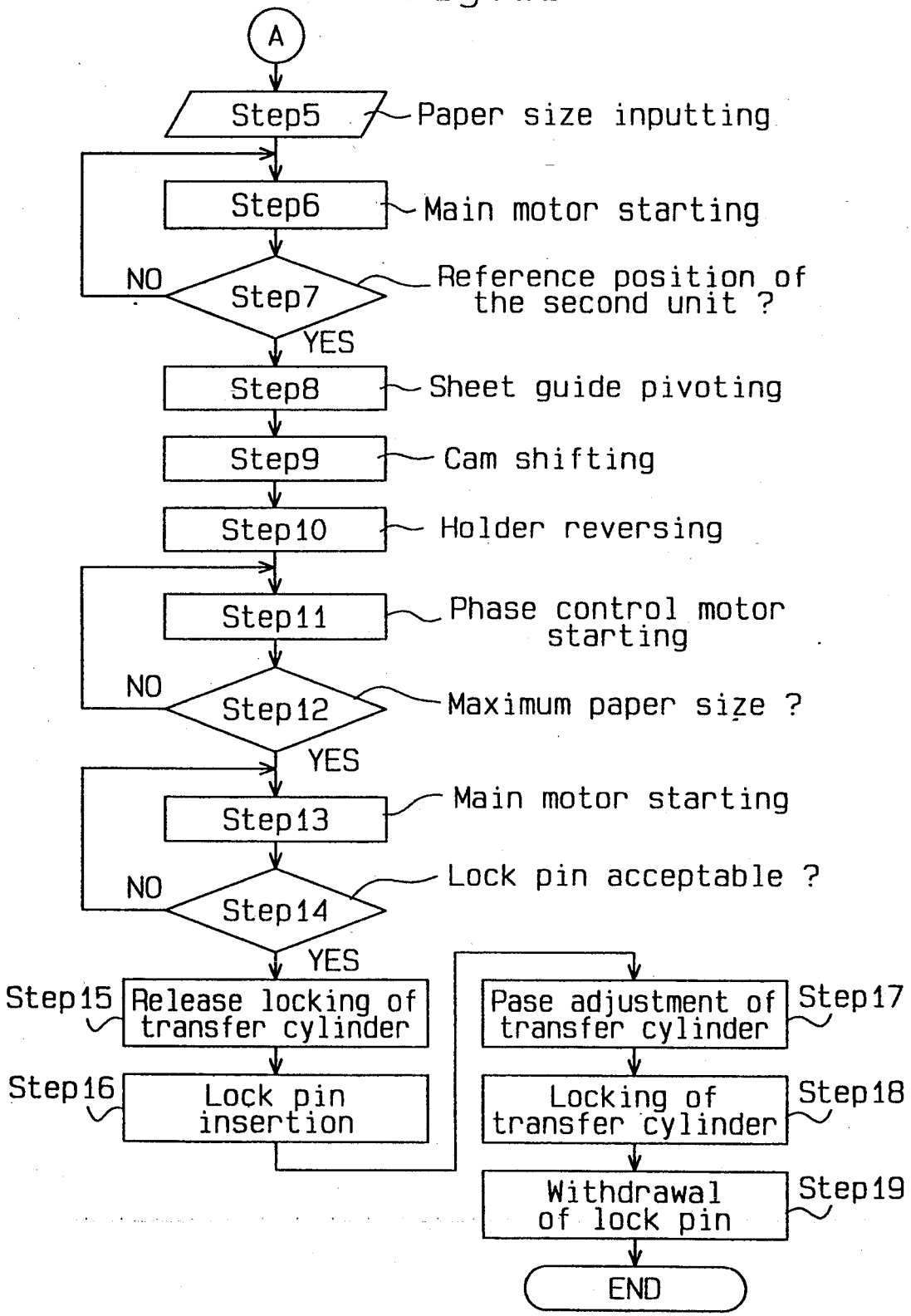
FIG. 11 is a flow chart showing the switching operation of the reversing mechanism in accordance with the switching from the single-surface two-color printing mode to the double-surface single-color printing mode.

When the single-surface two-color printing mode is changed to the double-surface single-color printing mode (A), the paper size is first input using the ten keys of the display 72 (Step 5), as shown in the flow chart of FIG. 11 and the timing chart of FIG. 12. Subsequently, the main motor 69 is operated (Step 6). Thus, the transfer cylinder 12 is driven to be turned to the position corresponding to the reference position in the second printing unit 2 in accordance with the signal from the timing detector 81 (Step 7).

The cam cylinder 86 is operated in this state, and the sheet guide 15 is brought to the retracted position (Step 8). The cams 54, 64 for opening and closing the holders 14 of the second feed cylinder 13 (see FIG. 7) are shifted for the double-surface printing mode in accordance with the functions of the cam cylinders 63, 78 (Step 9), and the cam 64 for reversing the position of the holders 14 (see FIG. 6) is shifted for the double-surface printing mode (Step 10).

Next, the phase control motor 41 shown in FIG. 6 is operated (Step 11) to adjust the phase of the second feed cylinder 13 to conform to the maximum paper size (Step 12). The main motor is operated again (Step 13), and the transfer cylinder 12 is turned to the position where it allows insertion of the lock pin 29 thereto in accordance with the signal from the timing detector 81 (Step 14). The locking of the front segment 12*a* and the rear segment 12*b* of the transfer cylinder 12 by the segment lock 24 is released (Step 15), and in this state the lock pin 29 is inserted into the recess 20*a* to immobilize the rear segment 12*b* onto the frame 28*a* (Step 16). It sometimes happens when the locking of these segments 12*a*, 12*b* by the segment lock 24 is released before insertion of the lock pin 29 into the recess 20*a* that the recess 20*a* dislocates relative to the lock pin 29 due to the inertia of these segments 12*a*,12*b*. However, since the pin 29 has a tapered surface at the tip in this embodiment, its minor dislocation can be absorbed.

The phase control motor 41 is then operated again to adjust the angle between the front segment 12*a* and the rear segment 12*b*, as well as, the phase of the second feed cylinder 13 are adjusted in accordance with the paper size input (Step 17). These two segments 12*a*,12*b* are immobilized by the segment lock 24 (Step 18), and then the lock pin 29 is withdrawn (Step 19). The printing mode switching operation is completed by undergoing the above procedures.

Figure 13:
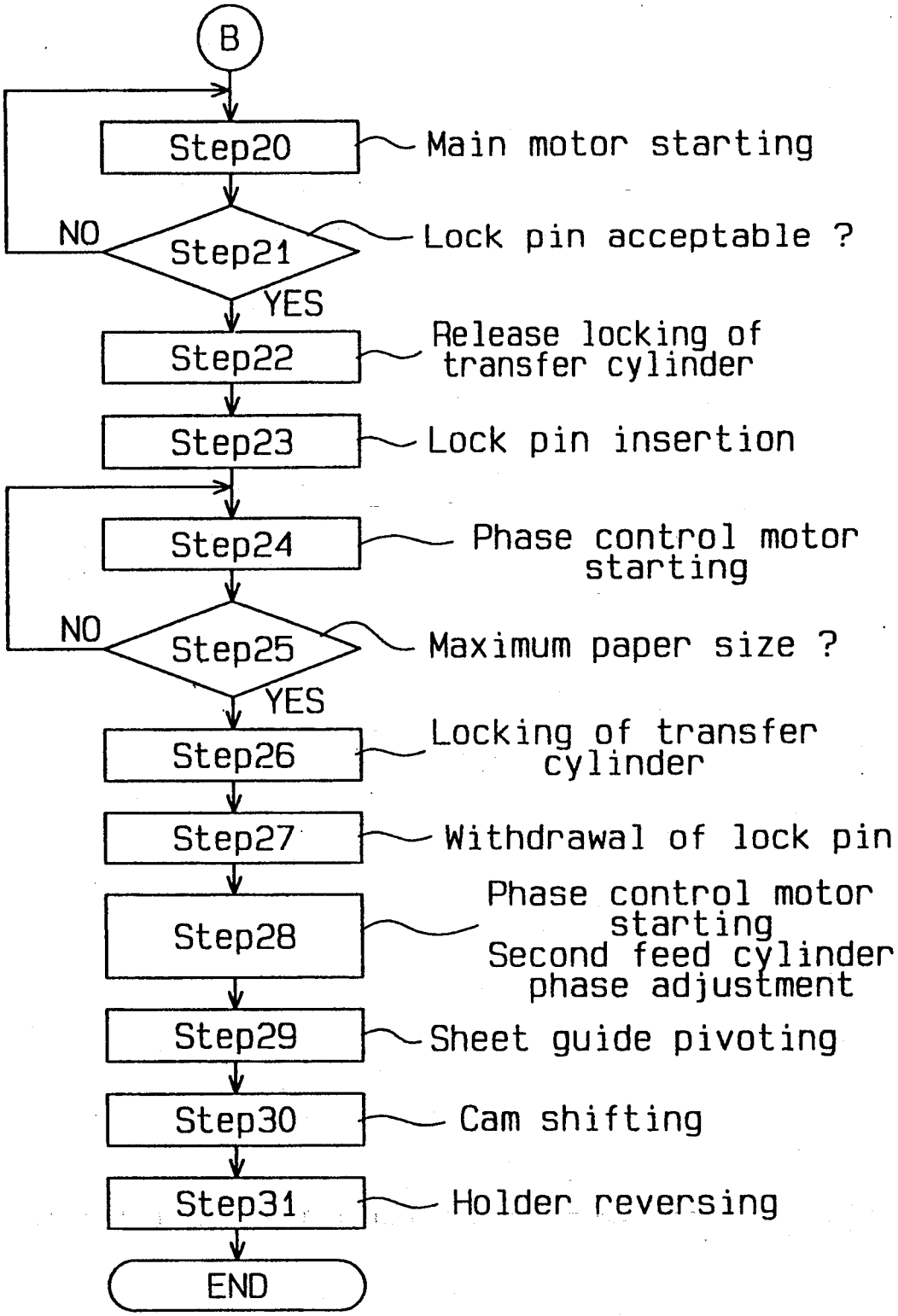
FIG. 13 is a flow chart showing the switching operation of the reversing mechanism in accordance with the switching from the double-surface single-color printing mode to the single-surface two-color printing mode.

The case where the double-surface single-color printing mode is to be changed to the single-surface two-color printing mode (B), contrary to the case mentioned above, will be described referring to the flow chart of FIG. 13 and the timing chart of FIG. 14. The main motor 69 is first operated (Step 20) to turn the transfer cylinder 12 to a position where it allows insertion of the lock pin 29 thereto in accordance with the signal from the timing detector 81 (Step 21), and the front segment 12*a* and the rear segment 12*b* of the transfer cylinder 12 are unlocked (Step 22). In this state, the rear segment 12*b* is immobilized by the lock pin 29 (Step 23). The phase control motor 41 is then operated (Step 24) to adjust the angle between the front segment 12*a* and the rear segment 12*b*, as well as, the phase of the second feed cylinder 13 to conform to the maximum paper size, respectively (Step 25). These two segments 12*a*,12*b* are immobilized to each other by the segment lock 24 (Step 26), and the locking of the rear segment 12*b* by the lock pin 29 is released (Step 27).

Next, the main motor 69 is rotated again to turn the second feed cylinder 13 to the reference position. Further, the phase control motor 41 is rotated to adjust the phase of the second feed cylinder 13 to a position where it allows single-surface printing, in accordance with the signal from the timing detector 81 (Step 28). In this state, the cam cylinder 86 of the sheet guide 15 is operated to bring the paper guide 15 to take the posture shown in FIG. 1 (Step 29) and to shift the cams 54, 65 for performing the single-surface printing mode, as well as, the cam 64 for performing the single-surface printing mode. The switching from the double-surface printing mode to the single-surface printing mode is completed by undergoing the above procedures.

Figure 15:
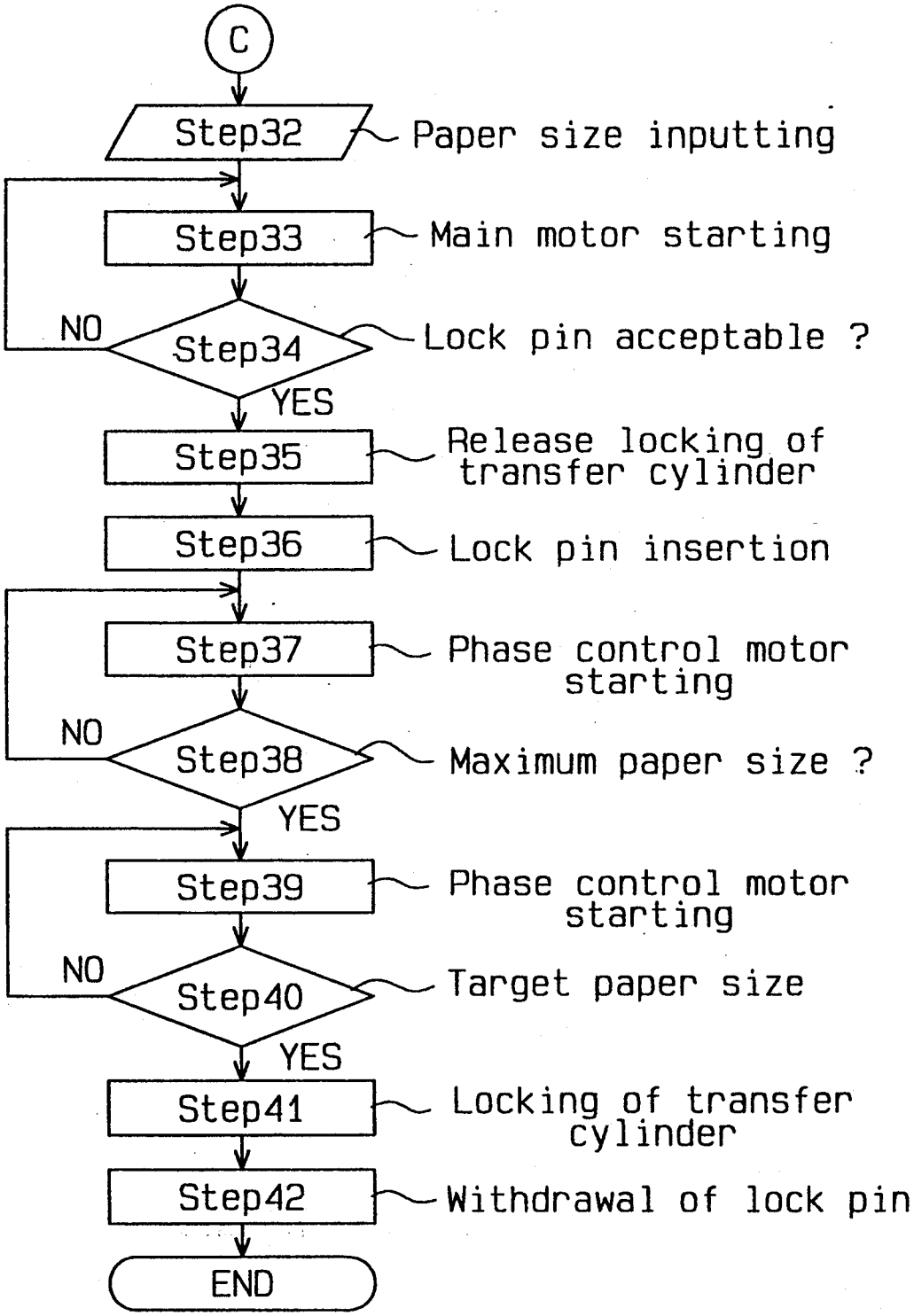
FIG. 15 is a flow chart showing the procedures of the adjusting operation in the reversing mechanism in the paper size change mode.

Next, the paper size changing mode (C) will be described referring to the flow chart of FIG. 15 and the timing chart of FIG. 16.

The paper size is first inputted by operating the ten keys on the display 72 (Step 32). The main motor 69 is then operated (Step 33) to turn the transfer cylinder 12 to the position where it allows insertion of the lock pin 29 thereto, in accordance with the signal from the timing detector 81 (Step 34). The front segment 12*a* and the rear segment 12*b* of the transfer cylinder 12 are then unlocked (Step 35), and in this state only the rear segment 12*b* is immobilized onto the frame by the lock pin 29 (Step 36). Subsequently, the phase control motor 41 is operated (Step 37) to adjust the angle between these two segments 12*a*,12*b* and the phase of the second feed cylinder 13 to conform to the maximum paper size (Step 38). The phase control motor 41 is then operated (Step 39) to adjust the angle between these segments 12*a*,12*b* and the phase of the second feed cylinder 13 to conform to the paper size input (Step 40).

Since the angle between these two segments 12*a*,12*b* and the phase of the second feed cylinder 13 are adjusted to conform to the maximum paper size before they are adjust to conform to the input paper size, detection errors by the respective sensors are not accumulated, allowing high accuracy adjustment. The segments 12*a*,12*b* are then immobilized to each other by the segment lock 24 (Step 41), and the locking of the second feed cylinder 13 by the lock pin 29 is released (Step 42). The paper size switching operation is completed by undergoing the above procedures.

As described above, in the offset press according to this embodiment, the adjustment of the angle between the front segment 12*a* and the rear segment 12*b* of the transfer cylinder 12, the phase adjustment of the second feed cylinder 13, and the shifting of the cams 54,64,65 for pivoting or opening and closing the holders 14 are carried out automatically in accordance with the mode selected. Accordingly, the switching from the single-surface two-color printing mode to the double-surface single-color printing mode or paper size changing can be performed in a short time, and also occurrence of defective prints due to mishandling in the switching operation can be prevented.

Second Embodiment

Next, another embodiment which additionally includes a cam ring for allowing the gripper of the transfer cylinder 12 to release the paper and a mechanism for adjusting the phase of the cam ring to the first embodiment will be described referring to the drawings. In the following description, the same constituents as in the first embodiment are affixed with the same reference numerals, and description thereof will be omitted.

Figure 18:
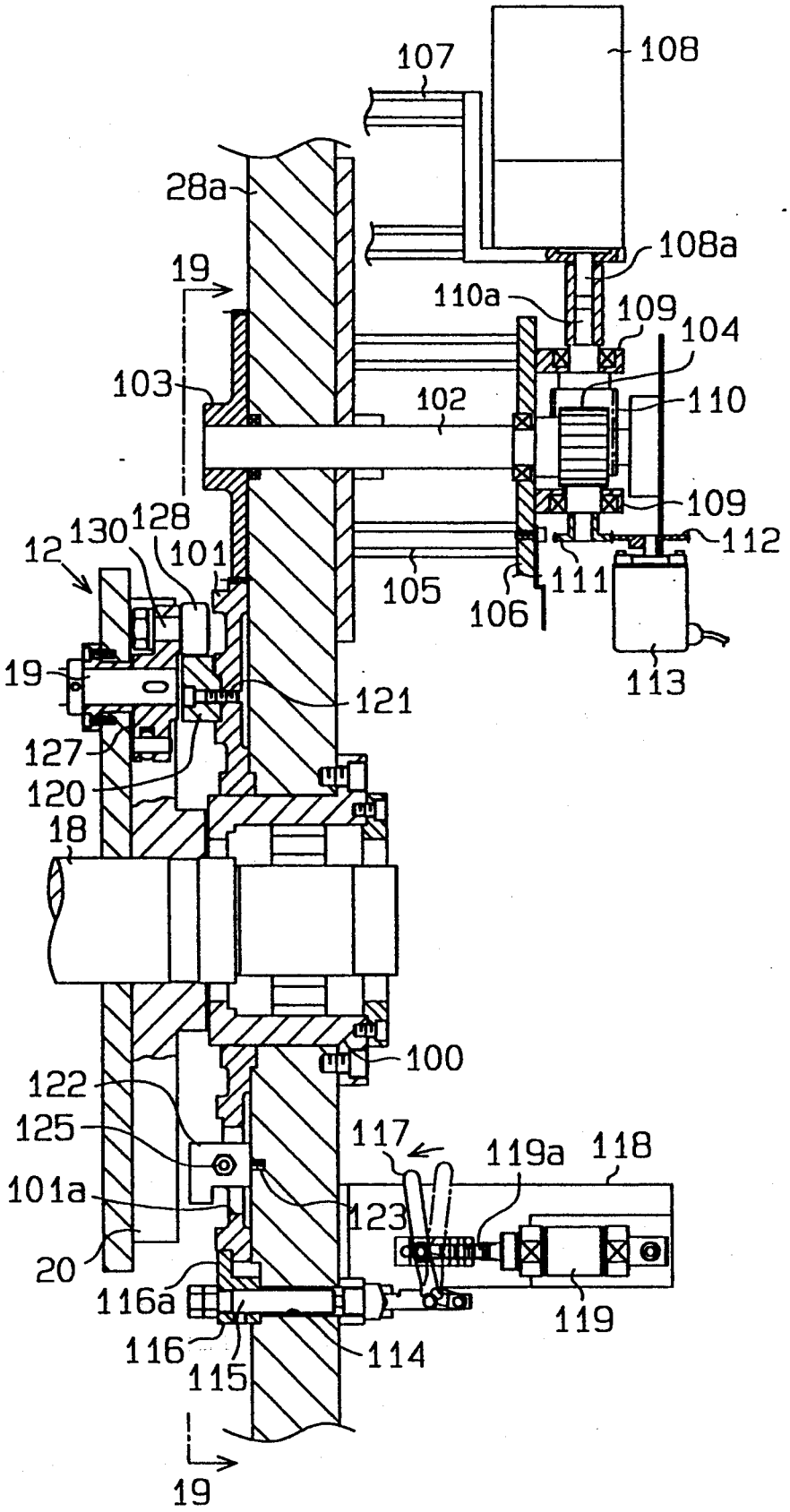
FIG. 18 shows in cross section the major portions of the cam ring adjusting mechanism according to a second embodiment of the invention, which is disposed near one end of the cylinder shaft of the transfer cylinder.
Figure 19:
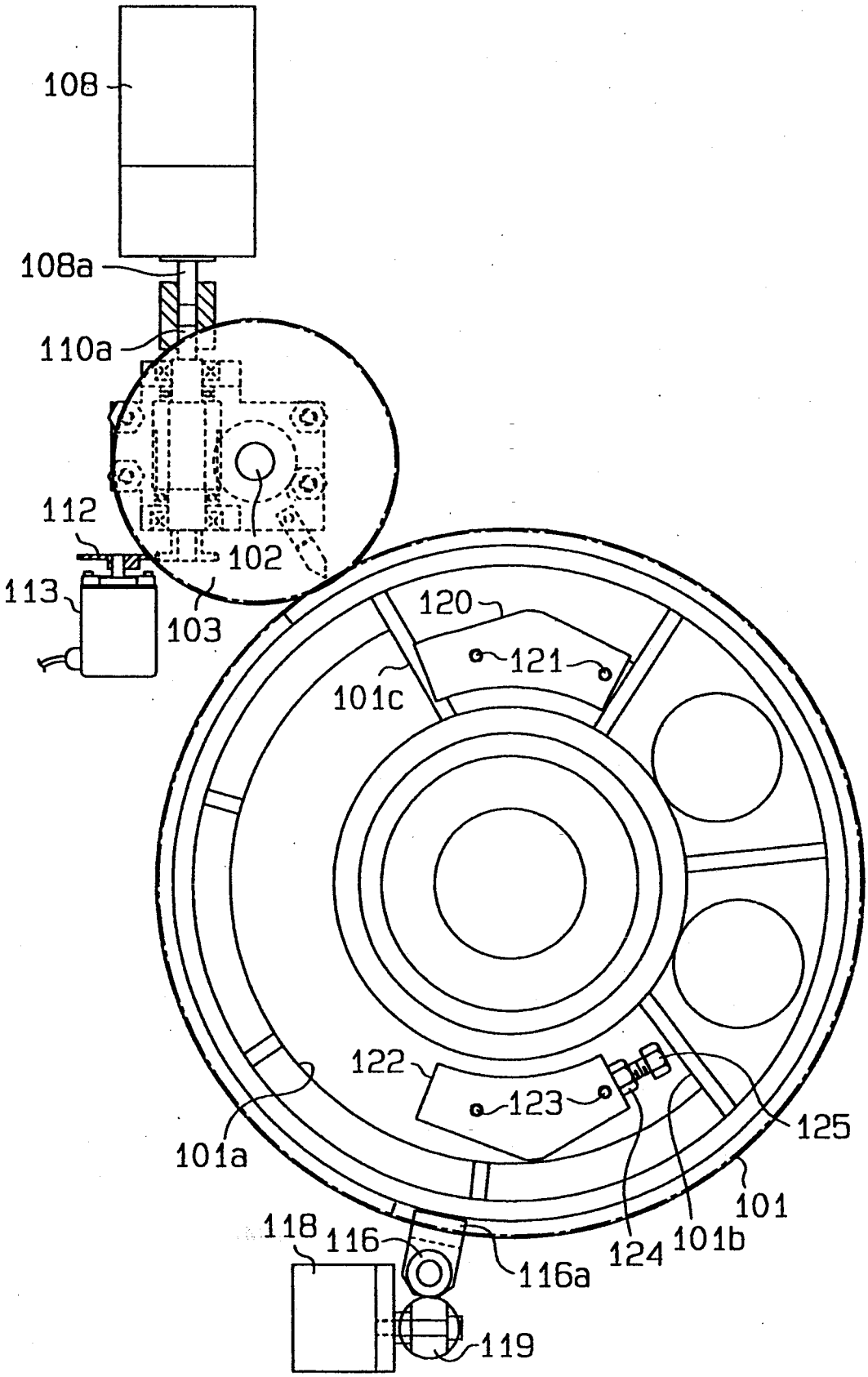
FIG. 19 is a cross section taken along the line 19—19 of FIG. 18, from which the frame is partially cut away.

As shown in FIGS. 18 and 19, a bearing 100 supports the cylinder shaft 18 rotatably therein. A disc-like cam ring 101 is rotatably mounted on the outer periphery of the bearing 100 so as to be in contact with the inner side of the frame 28*a*. A shaft 102 is provided on the frame 28*a* at a position adjacent to the cylinder shaft 18. A support plate 106 is fixed via a bracket 105 onto the frame 28*a*, and the shaft 102 is rotatably supported at the middle by the support plate 106. A gear 103 and a worm wheel 104 are fixed to the inner end portion and the outer end portion of the shaft 102, respectively. The circumference of the cam ring 101 is toothed and engaged with the gear 103.

A drive motor 108 is mounted via a bracket 107 onto the frame 28*a*. A pair of bearings 109 are mounted on the support plate 106, by which a worm 110 is rotatably supported at its worm shaft 110*a*. The shaft 108*a* of the drive motor 108 is connected to the worm shaft 110*a*. The worm 110 is engaged with the worm wheel 104 and transmits the rotation of the drive motor 108 to the shaft 102. The rotation of the drive motor 108 is further transmitted to the cam ring 101 via the gear 103. Accordingly, the cam ring 101 is turned around the bearing 100 by the drive motor 108 to adjust the phase of the cam ring 101.

A gear 111 is fixed to the other end of the worm shaft 110*a*. An encoder 113 is fixed via a bracket to the frame 28*a*, with a gear 112 being fixed on the output shaft of the encoder 113. The encoder 113 is connected via the gears 111,112 to the drive motor 108, so that the encoder 113 can detect the phase of the drive motor 108, i.e. the phase of the cam ring 101.

A guide hole 114 is defined through the frame 28*a* on the opposite side of the cylinder shaft 18 with respect to the shaft 102, into which a shaft 115 is slidably inserted. A holding member 116 having a protrusion 116*a* is fixed to the inner end of the shaft 115. The protrusion 116*a* of the holding member 116 is abutted against the circumference of the cam ring 101. When the shaft 115 is shifted outward (rightward in FIG. 18), the protrusion 116*a* presses the cam ring 101 against the inner wall of the frame 28*a*, whereby the cam ring 101 is securely held between the protrusion 116*a* and the frame 28*a* to be prevented from turning. Accordingly, if the shaft 115 is shifted as described above during printing, backlash of the cam ring 101 can be prevented to improve printing accuracy.

A lever 117 is pivotally supported at the proximal end to the outer end portion of the shaft 115. An air cylinder 119 is supported on the bracket 118 fixed to the frame 28*a*, and the shaft 119*a* thereof is connected to the lever 117. Upon operating the cylinder 119, the lever 117 is pivoted counterclockwise in FIG. 8 and the shaft 115 is shifted outward.

A movable cam 120 is fixed by a bolt 121 on the surface of the cam ring 101, which opposes to the transfer cylinder 12. An opening 101*a* is defined through the cam ring 101, and a fixed cam 122 is fixed by a bolt 123 to the frame 28*a* to locate in the opening 101*a*. The fixed cam 122 is used for allowing the grippers 16 to grasp the paper Pa being fed from the first feed cylinder 11 to the transfer cylinder 12, and the movable cam 120 is used for grasping the paper Pa being delivered from the transfer cylinder 12 to the second feed cylinder 13.

A nut 124 is fixed to the fixed cam 122, and a bolt stopper 125 is threaded into the nut 124. The stopper 125 opposes to one of the two inner walls 101*b* locating on both sides of the opening 101*a*. When the inner wall 101*b* of the cam ring 101 is engaged with the stopper 125 as it is turned, the cam ring 101 is reset to the reference position. The reference position can be adjusted by adjusting the amount of protrusion of the stopper 125.

Figure 20:
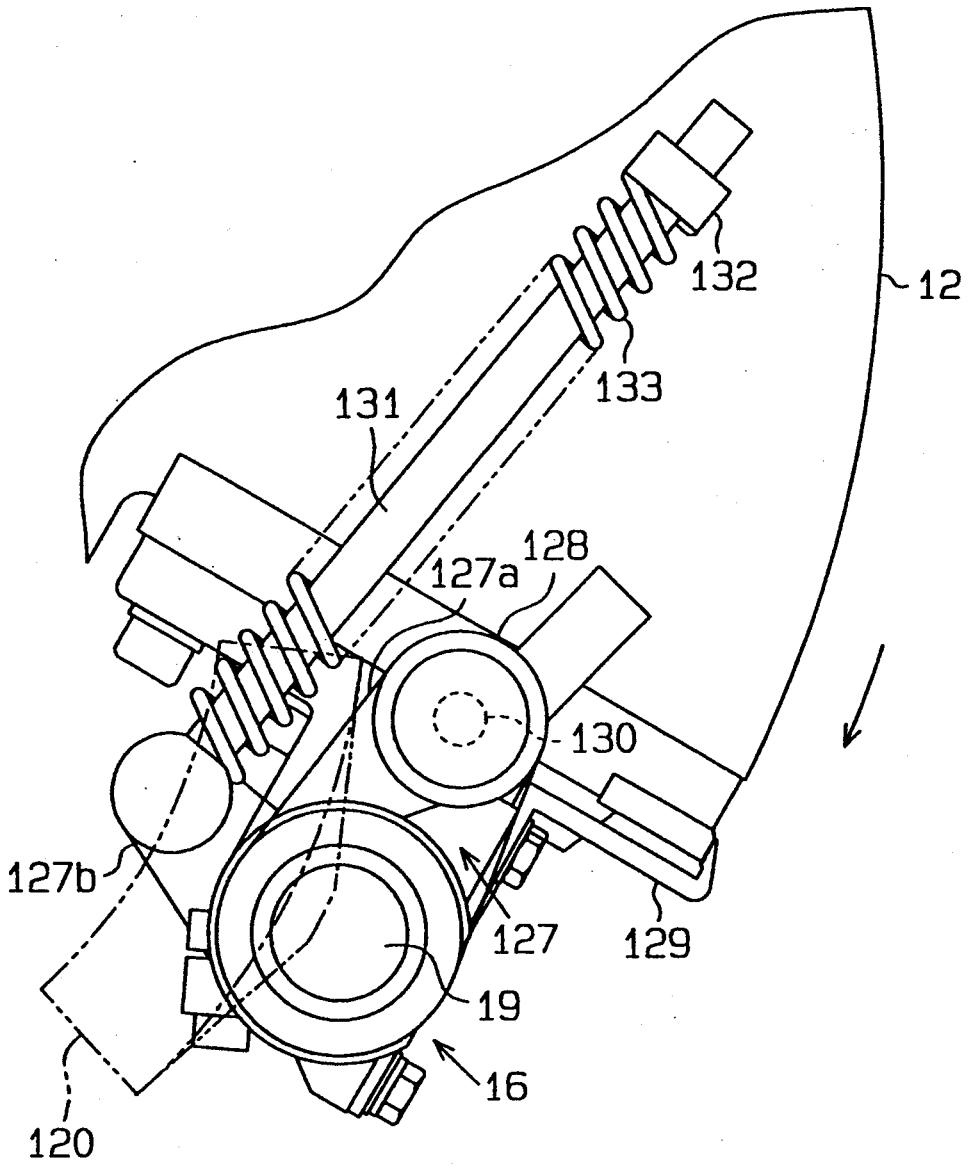
FIG. 20 shows in enlarged view the arm attached to the transfer cylinder.

As shown in FIGS. 18 and 20, one gripper 16 located at one end portion of the transfer cylinder 12 is provided with a clamp 129 for holding the paper Pa. The other grippers 16 are of the same constitution. An L-shaped arm 127 is fixed on the support shaft 19, and a cam follower 128 is disposed on a first end portion 127*a* thereof. The cam follower 128 is rotatably supported on the first end portion 127*a* by a shaft 130. A guide pin 131 is fixed at the proximal end to a second end portion 127*b* of the arm 127, with the tip thereof being slidably inserted into a guide 132 protruding from the side wall of the transfer cylinder 12. A coil spring 133 is disposed between the second end portion 127*b* of the arm 127 so as to wind around the guide pin 131. The spring 133 urges the clamps 129 counterclockwise, i.e. in the direction of holding the paper Pa.

When the transfer cylinder 12 is turned to bring the cam follower 128 into contact with the cam 120, the arm 127 is pivoted clockwise in FIG. 20 against the urging force of the spring 133. Then, the support shaft 19 is turned, to allow the clamps 129 to be spaced apart from the edge of the transfer cylinder 12 and release holding the paper Pa. When the cam follower 128 passes the cam 120, the clamps 129 are pivoted again toward the edge of the transfer cylinder 12 being urged by the spring 133, in the direction of holding the paper Pa.

When releasing locking of the cam ring 101 by the holding member 116 of the cam ring 101 to turn the ring 101 so as to adjust the phase thereof, the position of the movable cam 120 relative to the cam follower 128 can be changed, and the timing of releasing holding of the paper Pa by the grippers 16 can be changed.

Next, the control unit for controlling the mechanism for adjusting the phase of the cam ring 101 will be described. The phase adjustment of the cam ring 101 is carried out in parallel with the adjustment of the angle between the segments 12*a*,12*b* of the transfer cylinder 12, the phase adjustment of the second feed cylinder 13 and reversing of the holders 14, as described in the first embodiment.

Figure 21:
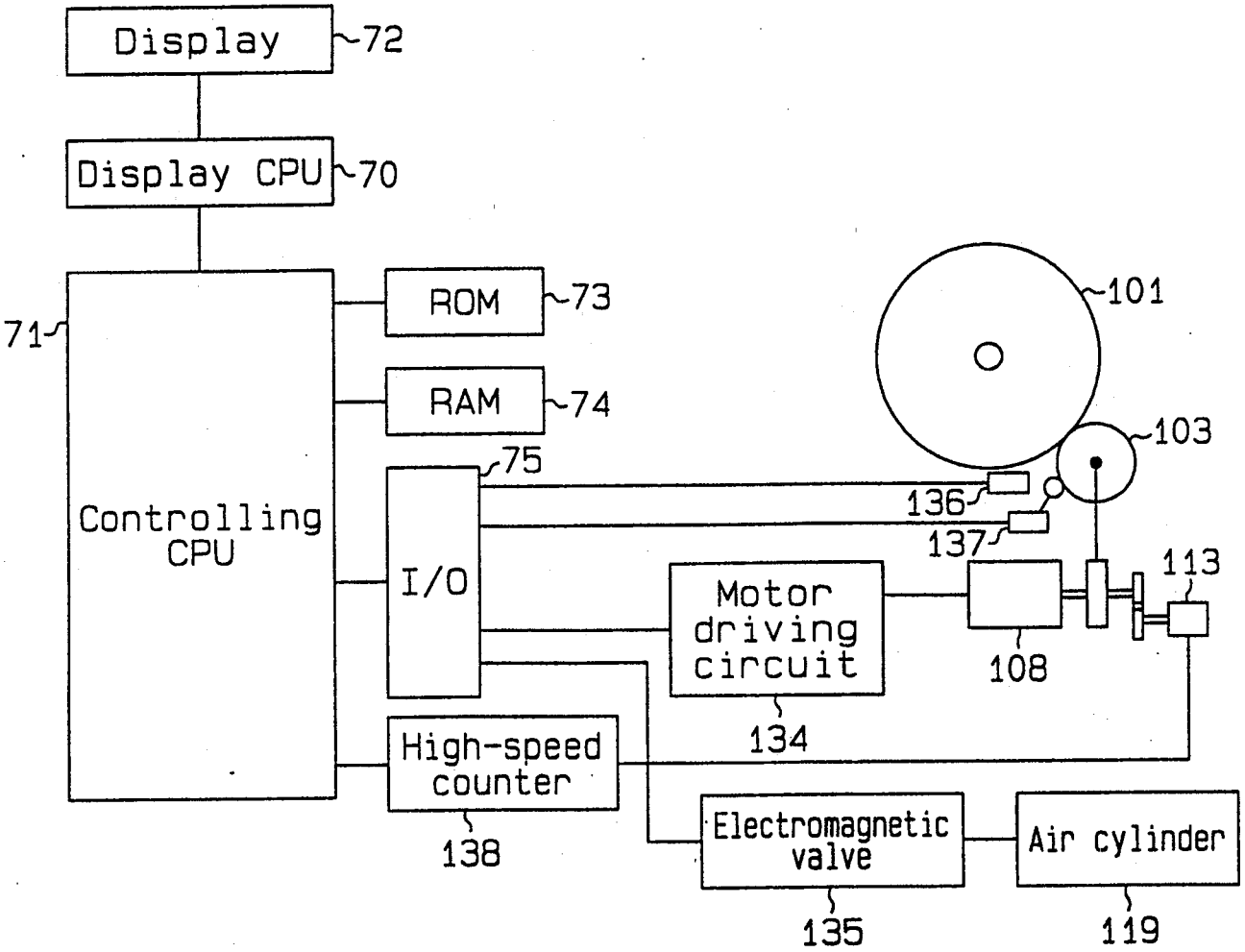
FIG. 21 is a block diagram showing the control system of the offset press according to the second embodiment of the invention.

As shown in FIG. 21, to the I/O unit 75 are connected the drive motor 108 via a drive circuit 134, and the air cylinder 119 via an electromagnetic valve 135. The control circuit 134 controls to rotate the drive motor 108 in a normal direction and a reverse direction and to apply braking force to the motor 108. Further, a sensor 136 for detecting the reference position of the cam ring and a switch 137 for detecting overrun thereof are connected to the I/O unit 75. The reference position detecting sensor 136 detects if the cam ring 101 is at the position where single-surface printing is to be carried out. The overrun switch 137 outputs a predetermined signal when the cam ring 101 is turned over a predetermined angle, in case of any malfunction occurred in the encoder 113 or the like.

Further, the encoder 113 is connected via a high-speed counter 138 to the CPU 71. The counter 138 counts the signals output from the encoder 113 and outputs the count to the CPU 71.

When the drive motor 108 is operated to adjust the phase of the cam ring 101 by the above control unit, the CPU 71 first outputs a signal to the electromagnetic valve 135 to release locking of the cam ring 101 by the holding member 116. The CPU 71 then outputs an electric signal to the drive circuit 134 via the I/O unit 75, whereby the circuit 134 allows the drive motor 108 to rotate in the normal or reverse direction. As the drive motor 108 rotates, the cam ring 101 is turned, and also the shaft of the encoder 113 is turned. The signals to be output from the encoder 113 as its shaft rotates are counted by the high-speed counter 138, and the phase of the cam ring 101 is calculated by the CPU 71 based on that count. When it is detected that the cam ring 101 reaches the predetermined phase as the result of calculation, the CPU 71 outputs a signal for stopping the drive motor 108. When the signal is input to the circuit 134, the drive motor 108 is stopped.

Figure 22:
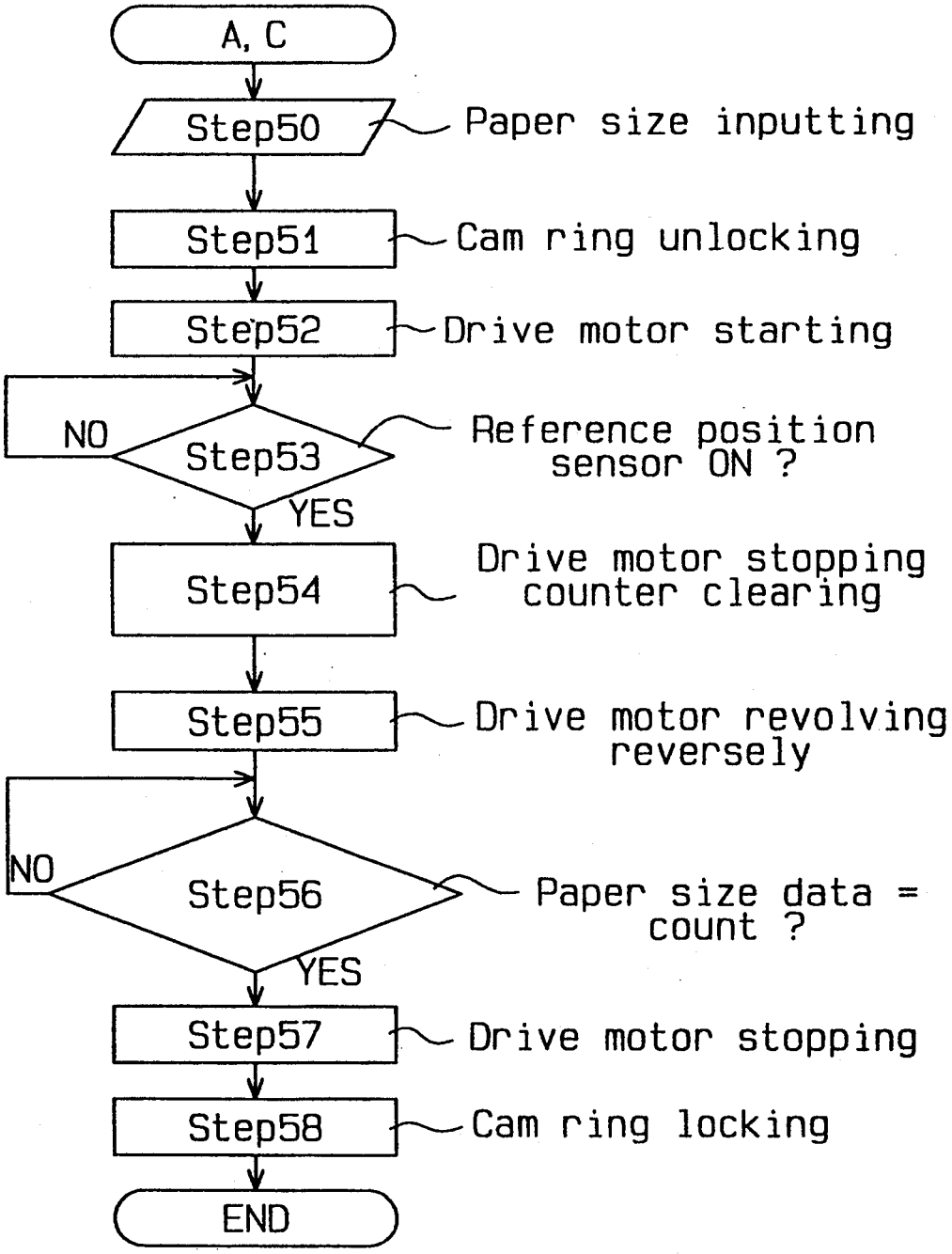
FIG. 22 is a flow chart showing the switching operation of the reversing mechanism in accordance with the switching from the single-surface two-color printing mode to the double-surface single-color printing mode, or in paper size change mode.

Next, the phase adjustment of the cam ring of the transfer cylinder in the thus constituted offset press will be descried referring to the flow chart shown in FIG. 22. It should be noted here that descriptions of the operations in the mode switching between the single-surface two-color printing and the double-surface printing or the paper size changing will be omitted, since they are the same as in those of the flow chart shown in FIG. 10.

In case of changing from the single-surface two-color printing mode to the double-surface printing mode (A) or of paper size changing (C), the same procedures as shown in the flow chart of FIG. 22 are carried out. Namely, the paper size is first input by the ten keys of the display 72 (Step 50). Next, the air cylinder 119 is operated to unlock the cam ring 101 (Step 51). When the drive motor 108 is operated (Step 52), the cam ring 101 is turned toward the single-surface printing position or the reference position. The CPU 71 determines if the reference position sensor 136 is ON or not (Step 53), and if the reference position sensor 136 is ON, the drive motor 108 is stopped and the internal data in the high-speed counter 138 is cleared (Step 54). Subsequently, the drive motor 108 is rotated reversely (Step 55) to turn the cam ring 101 to the position corresponding to the input paper size. The input paper size data is compared with the number of the input signals from the encoder 113 counted by the high-speed counter 138 (Step 56).

When the count coincides with the input paper size data, the drive motor 108 is stopped (Step 57). The CPU 71 further operates the air cylinder 119 to lock the cam ring 101 (Step 58). As described above, since the phase of the cam ring 101 is reset once to the reference position before it is adjusted in accordance with the paper size, the detection errors in the respective sensors are not accumulated, enabling accurate adjustment.

Figure 23:
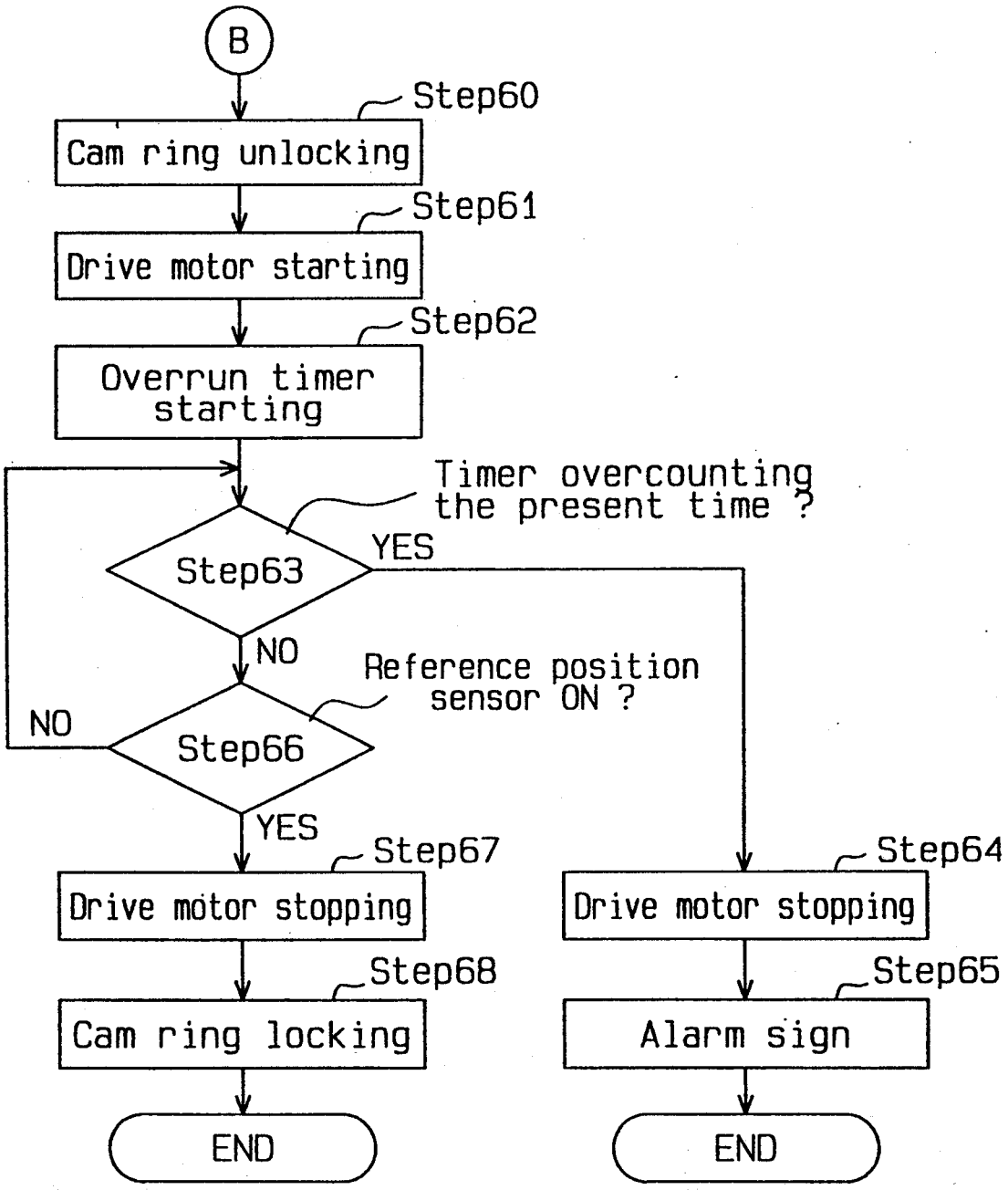
FIG. 23 is a flow chart showing the switching operation of the reversing mechanism in accordance with the switching from the double-surface single-color printing mode to the single-surface two-color printing mode.
Figure 24:
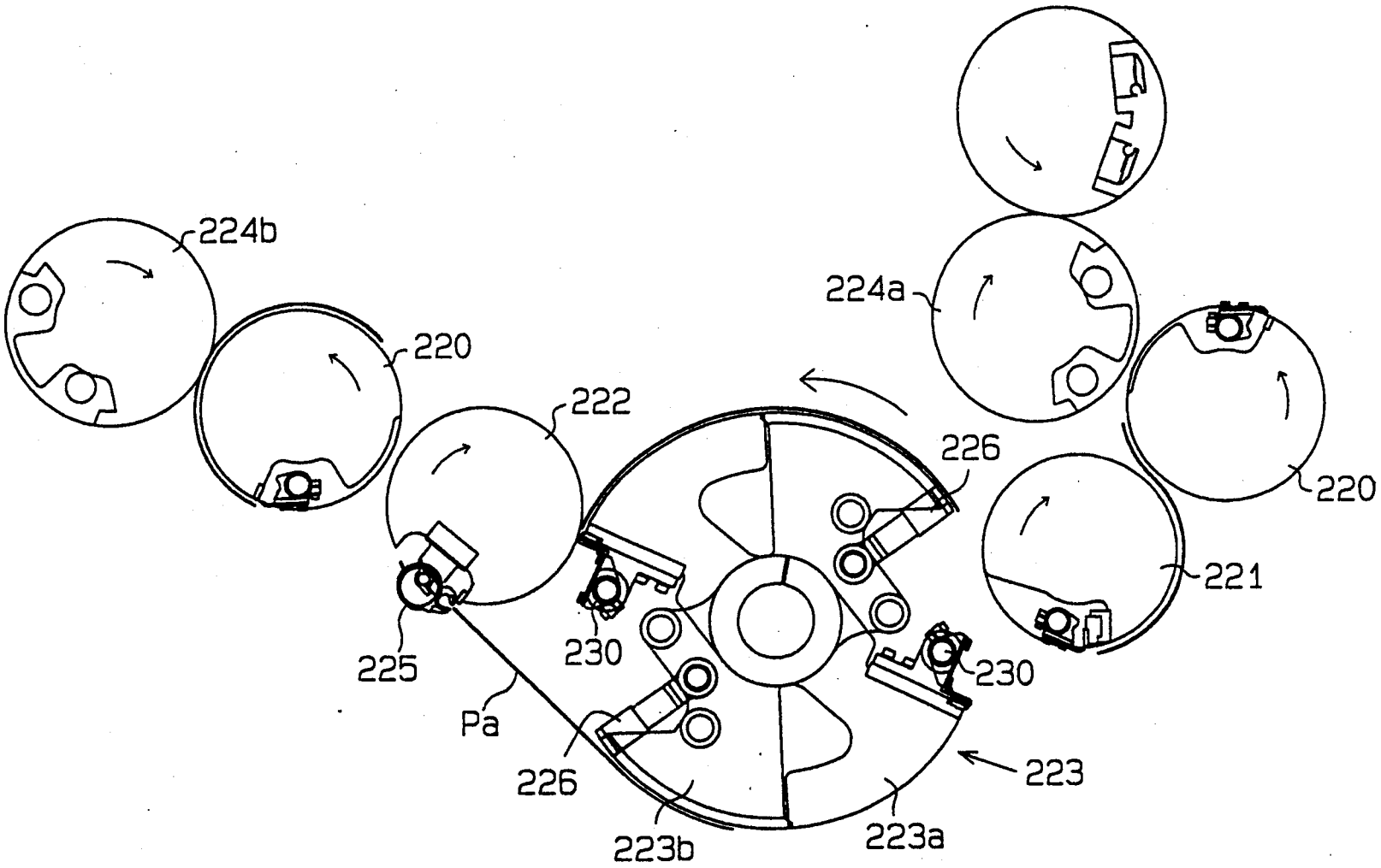
Fig.24 (Prior Art)
FIG. 24 shows in front view the reversing mechanism employed in a conventional offset press.
Figure 25:
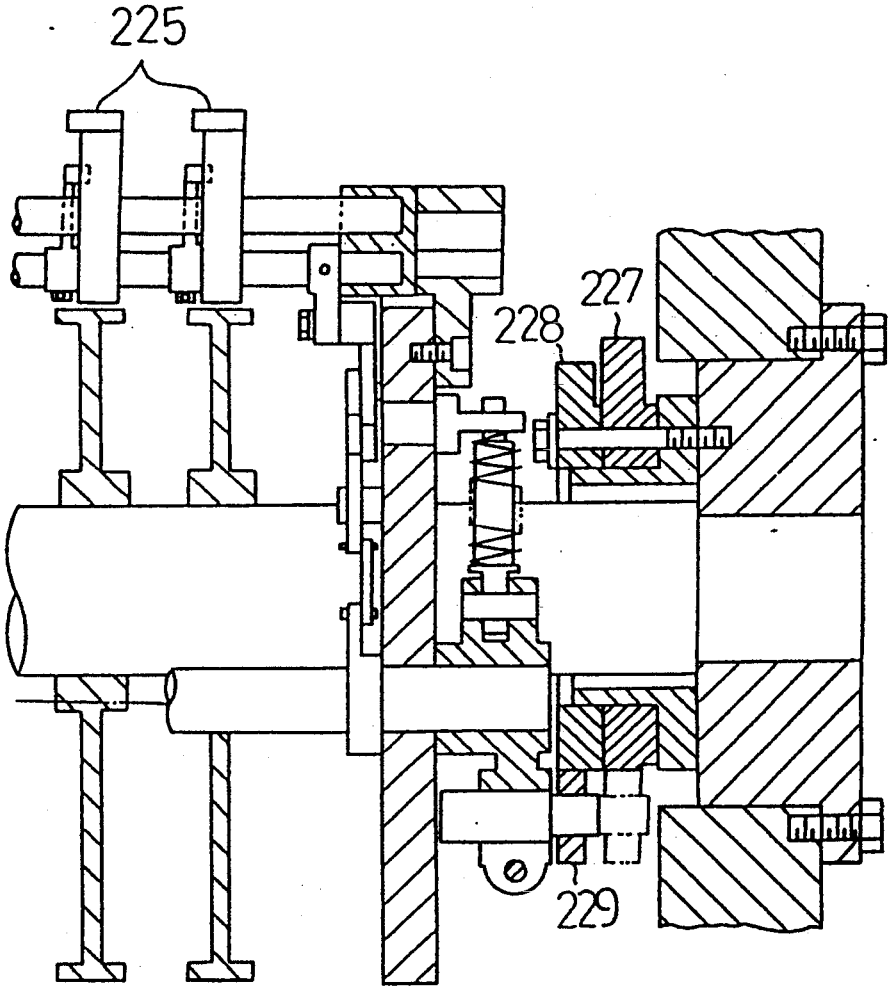
Fig. 25 (Prior Art)
FIG. 25 shows in cross section the major portions of the conventional cam shifting mechanism.

When the double-surface printing mode is contrariwise switched to the single-surface printing (B), the air cylinder 119 is first operated, as shown in FIG. 23, to unlock the cam ring 101 (Step 60). Next, the drive motor 108 is operated (Step 61) to allow the cam ring 101 to turn toward the single-surface printing position, i.e. the reference position. At this moment, counting by an overrun timer is started (Step 62). The CPU 71 determines if the cam ring 101 is erroneously turned exceeding the predetermined preset time based on the operation of the timer (Step 63), and if the cam ring 101 is turned exceeding the predetermined time, the drive motor 108 is stopped urgently (Step 64). The CPU 71 further indicates an alarm sign on the display 72 (Step 65).

If the ON-state of the reference position sensor 136 is confirmed before lapse of the preset time period by the overrun timer (Step 63,66), the drive motor 108 is stopped (Step 67). In this state, the air cylinder 119 is operated to lock the cam ring 101 (Step 68). The operation of adjusting the phase of the cam ring is completed by undergoing the above procedures.

As described above, the phase adjustment of the cam ring 101 of the transfer cylinder 12 in the offset press can be carried out in parallel with the angle adjustment between the segments **12*a*,12*b* of the transfer cylinder 12, the phase adjustment of the second feed cylinder 13 and the switching of the holders 14. Accordingly, mode switching can be completed in a short time. Further, since the press is provided with an overrun timer and a mechanical stopper 125, the drive motor can securely be stopped even if the reference position sensor 136** should be out of order.

It should be understood that the present invention is not limited to the constitutions of the embodiments described herein, but may be embodied in many other forms without departing from the spirit of the invention. For example, the present invention may be embodied in an offset press provided with three or more printing units or in other types of sheet-fed printers than offset press; or the gears 34,35 may be replaced with other transmission means such as pulleys and the like. Therefore, the present embodiments are to be considered as illustrative and not restrictive and the invention is not to be limited to the details given herein, but may be modified within the scope of the appended claims.

What is claimed is:

1. A sheet transferring apparatus for transferring a sheet between a plurality of printing units, wherein multiple color press on a single surface of the sheet and a single color press on both surfaces of the sheet are selectively performed, said apparatus comprising:

a feed cylinder rotatably provided between the adjacent units;

a power source for actuating the feed cylinder;

a first rotating member mechanically connected to the power source;

a second rotating member mechanically connected to the feed cylinder, said second member being arranged to be driven by said first member; and a phase adjusting mechanism for automatically adjusting a phase between the first and second members in accordance with the multiple color press and the single color press.

2. An apparatus according to claim 1 further comprising a brake for regulating the rotation of the feed cylinder.

3. An apparatus according to claim 1, wherein said adjusting mechanism includes:

a motor;

a decelerator operably connected to the first and second rotating members; and a rotary shaft mounted on the decelerator for connecting the decelerator to the motor, said rotary shaft being arranged to adjust the phase between the rotating members when the rotary shaft is rotated by the motor.

4. An apparatus according to claim 3 further comprising a clutch for controlling the power transmission between the motor and the rotary shaft.

5. An apparatus according to claim 3 further comprising:

an encoder connected to the motor, for detecting the rotation of the motor to generate a predetermined signal; and a controller for computing the phase between the first and second rotating members in accordance with the signal from the encoder.

6. An apparatus according to claim 1, wherein the first member includes a first gear and the second member includes a second gear driven by the first gear.

7. An apparatus according to claim 5, wherein the feed cylinder includes:

a plurality of holders mounted on the outer peripheral surface of the feed cylinder, said grippers being arranged to be selectively closed and opened for gripping and releasing the sheet;

a first and a second cams for selectively closing and opening said holders during the multiple color press on the single surface of the sheet;

a first and a second cam followers connected to the holders, said first and second cam followers being arranged to releasably engage with the first and the second cams, respectively;

a first cam switching mechanism for making the engagement of the first and the second cams with the first and the second cam followers respectively during the multiple color press on the single surface of the sheet;

a third cam for reversing the holders during the single color press on both surfaces of the sheet; and a second cam switching mechanism for making the engagement of the third cam with the second cam follower after causing the second cam to release from the second cam follower during the single color press on both surfaces of the sheet.

8. An apparatus according to claim 7 further comprising a plurality of air cylinders for actuating the associated cam switching mechanisms based on control signal from the controller.

9. An apparatus according to claim 5 further comprising a transfer cylinder operably connected to the feed cylinder, for supplying the sheet which is delivered by the feed cylinder to the adjacent printing unit.

10. An apparatus according to claim 9, wherein said transfer cylinder includes:

a cylinder shaft;

a front segment secured to the cylinder shaft, said segment having a plurality of grippers;

a rear segment rotatably connected to the cylinder shaft;

an angle adjusting mechanism connecting the rear segment to the front segment, said angle adjusting mechanism being arranged to adjust the angler distance between the front and rear segments; and actuating means for actuating angle adjusting mechanism.

11. An apparatus according to claim 10, wherein said transfer cylinder has a lock member for regulating the rotation of the rear segment during the adjustment of angular distance between the segments.

12. A printing machine having an apparatus as claimed in claim 10 having:

data input means for use of inputting data indicative of the sheet size; and wherein said controller controls said actuating means in response to the sheet size data supplied from the input means.

13. A printing machine as claimed in claim 12 further comprising means for detecting operation of the actuating means.

14. A sheet transferring apparatus for transferring a sheet between a plurality of printing units, wherein multiple color press on a single surface of the sheet and a single color press on both surfaces of the sheet are selectively performed, said apparatus comprising:

a feed cylinder rotatably provided between the adjacent units;

a power source for actuating the feed cylinder;

a first rotating member mechanically connected to the power source;

a second rotating member mechanically connected to the feed cylinder, said second member being arranged to be driven by said first member;

a phase adjusting mechanism for adjusting a phase between the first and second members; and a transfer cylinder operably connected to the feed cylinder, for supplying the sheet which is delivered by the feed cylinder to the adjacent printing unit.

15. An apparatus according to claim 14, wherein the feed cylinder includes:

a plurality of grippers mounted on the outer peripheral surface of the feed cylinder, said grippers being arranged to be selectively closed and opened for gripping and releasing the sheet;

a first and a second cams for selectively closing and opening said grippers during the multiple color press on the single surface of the sheet;

a first and a second cam followers connected to the grippers, said first and second cam followers being arranged to releasably engage with the first and the second cams, respectively;

a first cam follower actuating mechanism for making the engagement of the first and the second cam followers with the first and the second cams respectively during the multiple color press on the single surface of the sheet;

a third cam for reversing the grippers during the single color press on both surfaces of the sheet; and a second cam follower actuating mechanism for making the engagement of the second cam follower with the third cam after causing the second cam follower to release from the second cam during the single color press on both surfaces of the sheet.

16. An apparatus according to claim 15 further comprising a plurality of air cylinders for actuating the associated cam follower actuating mechanisms based on control signal from the controller.

17. An apparatus according to claim 14, wherein said transfer cylinder including:

a cylinder shaft;

a front segment secured to the cylinder shaft, said segment having a plurality of grippers;

a rear segment rotatably connected to the cylinder shaft;

an angle adjusting mechanism connecting the rear segment to the front segment, said angle adjusting mechanism being arranged to adjust the angler distance between the front and rear segments; and actuating means for actuating angle adjusting mechanism.

* * * * *